US009587867B2

(12) United States Patent
Lee et al.

(10) Patent No.: US 9,587,867 B2
(45) **Date of Patent: *Mar. 7, 2017**

(54) CHILLER SYSTEM AND CONTROL METHOD THEREOF

(71) Applicant: LG Electronics Inc., Seoul (KR)

(72) Inventors: Horim Lee, Seoul (KR); Seulki On, Seoul (KR); Jinhyuk Yu, Seoul (KR); Yoonjei Hwang, Seoul (KR); Hanyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/045,896

(22) Filed: Feb. 17, 2016

(65) Prior Publication Data

US 2016/0238299 A1 Aug. 18, 2016

Related U.S. Application Data

(62) Division of application No. 14/094,943, filed on Dec. 3, 2013.

(30) Foreign Application Priority Data

Feb. 1, 2013 (KR) ..... 10-2013-0011745
Apr. 16, 2013 (KR) ..... 10-2013-0041692

(51) Int. Cl.
*F25B 49/02* (2006.01)
*F25B 1/053* (2006.01)
(Continued)

(52) U.S. Cl.
CPC ..... *F25B 49/02* (2013.01); *F24F 13/04* (2013.01); *F25B 1/053* (2013.01); *F25B 25/005* (2013.01);
(Continued)

(58) Field of Classification Search
CPC ..... F25B 49/02; F25B 25/005; F25B 31/004; F25B 1/053; F25B 43/003;
(Continued)

(56) References Cited

U.S. PATENT DOCUMENTS 3,179,162 A * 4/1965 McFarlan ..... F24D 5/00 165/210
3,555,251 A * 1/1971 Shavit ..... F24F 11/00 165/287
(Continued)

FOREIGN PATENT DOCUMENTS

CN 1295224 A 5/2001
CN 101448702 A 6/2009
(Continued)

OTHER PUBLICATIONS

U.S. Appl. No. 14/094,943, filed Dec. 3, 2013.

*Primary Examiner* — Mohammad M Ali
(74) *Attorney, Agent, or Firm* — Dentons US LLP

(57) ABSTRACT

A chiller system and a control method thereof includes a plurality of chiller modules in which a refrigeration cycle is performed to supply cold water, a main control device generating an operation signal to simultaneously or successively operate the plurality of chiller modules, a module control device provided in each of the plurality of chiller modules to control an operation of each of the plurality of chiller modules on the basis of the operation signal of the main control device, and a starting device communicably connected to the module control device to selectively apply power into the plurality of chiller modules.

8 Claims, 33 Drawing Sheets

(51) Int. Cl.

| | |
|---|---|
| ***F25B 25/00*** | (2006.01) |
| ***F24F 13/04*** | (2006.01) |
| ***F25B 43/00*** | (2006.01) |
| *F25B 1/10* | (2006.01) |
| *F25B 31/00* | (2006.01) |

(52) U.S. Cl.
CPC ..... *F25B 31/004* (2013.01); *F25B 43/003* (2013.01); *F25B 1/10* (2013.01); *F25B 31/008* (2013.01); *F25B 2339/0242* (2013.01); *F25B 2339/047* (2013.01); *F25B 2400/04* (2013.01); *F25B 2400/0411* (2013.01); *F25B 2400/06* (2013.01); *F25B 2400/13* (2013.01); *F25B 2400/23* (2013.01); *F25B 2700/13* (2013.01); *F25B 2700/151* (2013.01); *F25B 2700/21171* (2013.01)

(58) Field of Classification Search
CPC ..... F25B 2339/047; F25B 2700/13; F25B 2339/0242; F25B 2400/23; F25B 2700/21171; F25B 2400/0411; F25B 2700/151; F25B 2400/06; F25B 2400/13; F24F 13/04
USPC ..... 62/125, 126
See application file for complete search history.

(56) References Cited

U.S. PATENT DOCUMENTS

| | | | | | |
|---|---|---|---|---|---|
| 3,628,600 | A * | 12/1971 | McFarlan | F24F 3/0444 | 165/220 |
| 3,842,901 | A * | 10/1974 | McFarlan | F24F 3/10 | 165/218 |
| 4,084,406 | A | 4/1978 | Brenneman | F04D 27/0284 | 318/779 |
| 4,210,957 | A | 7/1980 | Spethmann | F24F 11/06 | 165/260 |
| 4,483,152 | A * | 11/1984 | Bitondo | F25B 49/02 | 236/1 EA |
| 4,926,649 | A * | 5/1990 | Martinez, Jr. | F24F 3/06 | 236/91 F |
| 5,090,207 | A * | 2/1992 | Gilbertson | F25D 16/00 | 137/565.34 |
| 5,209,078 | A * | 5/1993 | Conrad | B60H 1/3202 | 137/62 |
| 6,202,431 | B1 | 3/2001 | Beaverson | F04D 27/0207 | 62/196.3 |
| 6,405,103 | B1 | 6/2002 | Ryan | G05B 15/02 | 700/19 |
| 6,679,076 | B1 | 1/2004 | Duga | F25B 49/025 | 62/228.1 |
| 6,681,594 | B1 * | 1/2004 | Nelson | B67D 1/0864 | 62/389 |
| 7,143,591 | B2 | 12/2006 | Nonaka | F25B 49/025 | 62/129 |
| 8,973,379 | B2 | 3/2015 | Bittner | F25B 49/02 | 62/79 |
| 2002/0170304 | A1 * | 11/2002 | Beaverson | F04D 27/0207 | 62/228.3 |
| 2003/0186097 | A1 | 10/2003 | Demissie | H01M 8/04007 | 429/434 |
| 2004/0065095 | A1 | 4/2004 | Osborne | F24F 3/00 | 62/160 |
| 2005/0039904 | A1 | 2/2005 | Aler | F24F 3/06 | 165/219 |
| 2005/0103032 | A1 | 5/2005 | Pierson | F01K 23/10 | 62/175 |
| 2005/0217484 | A1 | 10/2005 | Bourgault | F24F 1/04 | 95/273 |
| 2007/0164623 | A1 | 7/2007 | Randall | H05K 7/1432 | 310/89 |
| 2007/0261421 | A1 * | 11/2007 | Pierson | F01K 23/10 | 62/175 |
| 2008/0271881 | A1 | 11/2008 | Blecker | F24F 3/06 | 165/254 |
| 2009/0126691 | A1 | 5/2009 | Bach | F02B 29/0418 | 123/480 |
| 2009/0171512 | A1 | 7/2009 | Duncan | F24F 5/0035 | 700/300 |
| 2010/0023171 | A1 | 1/2010 | Bittner | F25B 49/02 | 700/282 |
| 2010/0084125 | A1 | 4/2010 | Goldstein | F17C 11/00 | 165/287 |
| 2010/0217444 | A1 * | 8/2010 | Watanabe | F25D 17/02 | 700/282 |
| 2011/0022193 | A1 | 1/2011 | Panaitescu | A41D 20/00 | 700/29 |
| 2011/0137468 | A1 | 6/2011 | Duncan | F24F 5/0035 | 700/277 |
| 2011/0167853 | A1 | 7/2011 | Kawaai | F25B 5/02 | 62/228.3 |
| 2011/0215645 | A1 | 9/2011 | Schomburg | H02J 9/061 | 307/65 |
| 2011/0240457 | A1 | 10/2011 | Wolfe | B01D 1/223 | 203/40 |
| 2011/0307102 | A1 | 12/2011 | Czamara | H05K 7/1497 | 700/277 |
| 2012/0055184 | A1 * | 3/2012 | Ueda | F04D 25/16 | 62/115 |
| 2012/0087836 | A1 * | 4/2012 | Littleford | B01D 53/1418 | 422/162 |
| 2012/0131935 | A1 * | 5/2012 | Kim | F24F 3/0442 | 62/115 |
| 2012/0168113 | A1 * | 7/2012 | Karamanos | F24F 1/0059 | 165/11.1 |
| 2012/0174609 | A1 * | 7/2012 | Matsuo | F24F 11/006 | 62/190 |
| 2012/0174614 | A1 * | 7/2012 | Cho | F25B 1/10 | 62/468 |
| 2012/0181009 | A1 | 7/2012 | Blecker | F25B 29/003 | 165/205 |
| 2012/0218711 | A1 * | 8/2012 | Kashirajima | F25B 25/00 | 361/700 |
| 2012/0240614 | A1 | 9/2012 | Norbeck | F25B 49/025 | 62/498 |
| 2012/0247114 | A1 * | 10/2012 | Pierson | F02C 7/14 | 60/772 |
| 2012/0292008 | A1 * | 11/2012 | Goldberg | F28D 21/0014 | 165/287 |

FOREIGN PATENT DOCUMENTS

| | | |
|---|---|---|
| JP | 5248148 | 4/1977 |
| KR | 20100128956 A | 12/2010 |
| KR | 1020110097203 A | 8/2011 |

* cited by examiner

CHILLER SYSTEM AND CONTROL METHOD THEREOF

CROSS-REFERENCE TO RELATED APPLICATIONS

The present application is a Divisional application of U.S. patent application Ser. No. 14/094,943 filed on Dec. 3, 2013, which claims priority under 35 U.S.C. 119 and 35 U.S.C. 365 to Korean Patent Application No. 10-2013-0011745 (filed on Feb. 1, 2013) and No. 10-2013-0041692 (filed on Apr. 16, 2013), which are hereby incorporated by reference in their entirety as if fully set forth herein.

BACKGROUND

The present disclosure relates to a chiller system and a control method thereof.

In general, chiller units are devices for supplying cold water. In chiller units, a refrigerant circulating in a refrigeration system and cold water circulating between warm areas and the refrigeration system are heat-exchanged with each other to cool the cold water. Chiller units may be high-capacity facilities and installed in large-scaled buildings.

Such a chiller unit may have various sizes or capacities. Here, the size or capacity of the chiller unit may correspond to capacity of a refrigeration system, i.e., refrigeration ability and expressed as a unit of a refrigeration ton (RT).

A chiller unit, according to the related art, may be provided with various refrigeration capacity for a building in which the chiller unit is installed, a capacity of circulating cold water, or an air-conditioning capacity. For example, the chiller unit may be manufactured to have about 1,000 RT, about 1,500 RT, about 2,000 RT, about 3,000 RT, and the like.

In general, as the chiller unit increases in capacity, the chiller unit increases in volume.

However, since the chiller unit is a high-capacity facility, it takes several months to manufacture a product after a specific capacity is selected. Thus, dissatisfaction with the manufacturing lead time has grown.

Also, when the chiller unit breaks down, the overall operation of the chiller unit may be restricted, and it may take a long time to repair the chiller unit. Thus, air conditioning operation with respect to the whole building may be restricted.

SUMMARY

Embodiments describe a chiller system having superior productivity and market responsiveness.

In one embodiment, a chiller system includes: a plurality of chiller modules capable of performing a refrigeration cycle to supply cold water; a main control device that generates an operation signal to simultaneously or successively independently operate each of the plurality of chiller modules; a plurality of module control devices provided in each of the plurality of chiller modules that control an operation of each of the plurality of chiller modules, respectively, on the basis of the operation signal of the main control device; and a starting device communicably connected to the module control devices that selectively apply power to the plurality of chiller modules.

In another embodiment, a method for controlling a chiller system includes: determining an operation load of the chiller system comprising a plurality of chiller modules; determining a number of the plurality of chiller modules to be operated on the basis of the operation load of the chiller system and a refrigeration capability required for the chiller system; and simultaneously or successively starting at least one of the plurality of chiller modules according to the number of chiller modules to be operated, wherein starting at least one of the plurality of chiller modules includes switching a plurality of switching members respectively connected to the plurality of chiller modules.

In a further embodiment, a chiller system includes: a plurality of chiller modules in which a refrigeration cycle using an odd number of chiller modules is performed to supply cold water, the plurality of chiller modules each comprising a condenser in which coolant is circulated and an evaporator in which cold water is circulated; a module control device to generate an operation signal to simultaneously or successively operate the plurality of chiller modules, the module control device controlling operations of the chiller modules; a water tube disposed within the condenser or the evaporator to guide a flow of the coolant or the cold water; a first cap assembly disposed on one side of the plurality of chiller modules, the first cap assembly comprising an inlet for the cold water or the coolant and an outlet for the cold water and the coolant; and a passage partition part disposed on the first cap assembly to restrict introduction of the cold water through the inlet into the water tube of the condenser or the evaporator.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
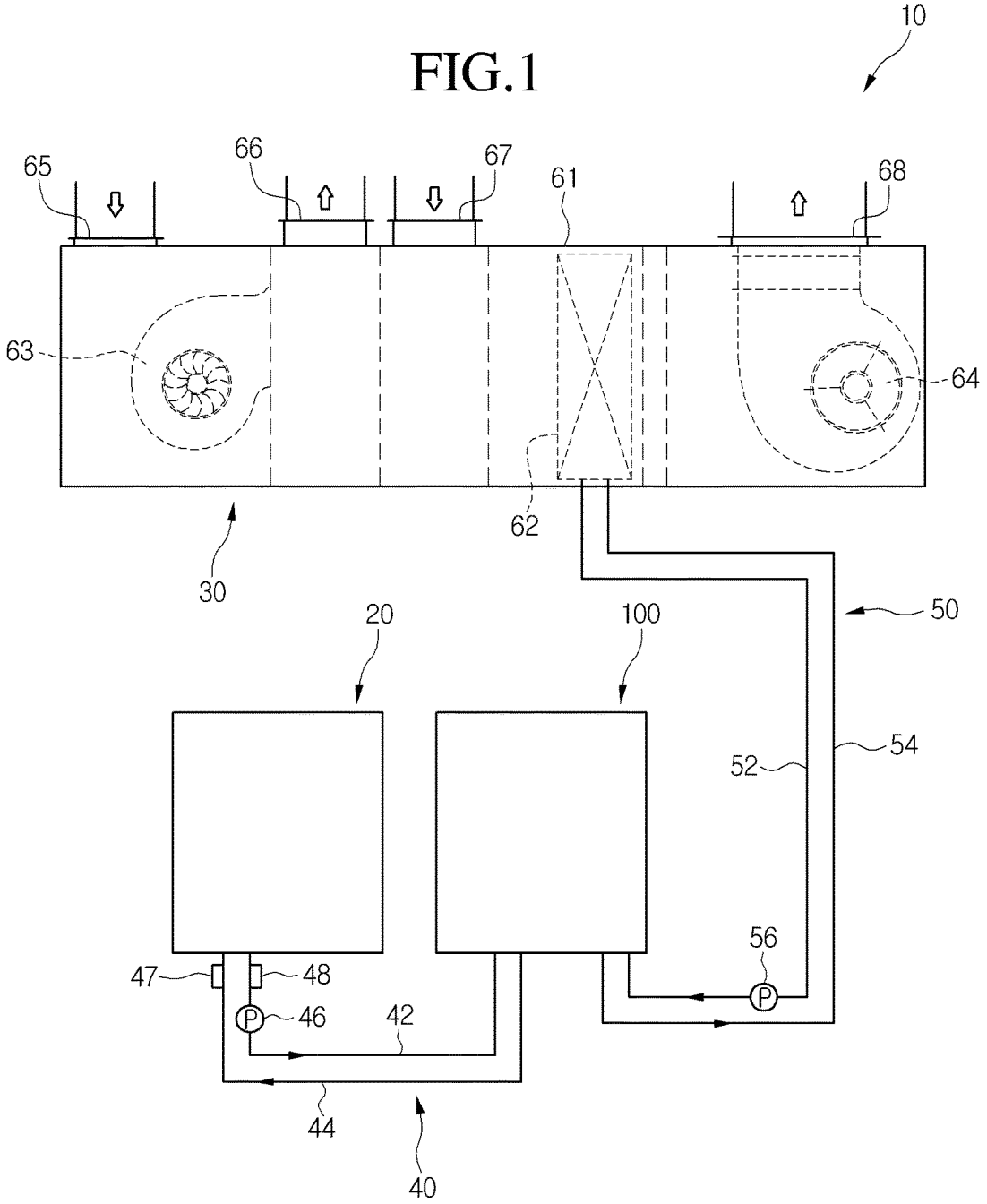
FIG. 1 is a view of a chiller system according to a first exemplary embodiment.
Figure 2:
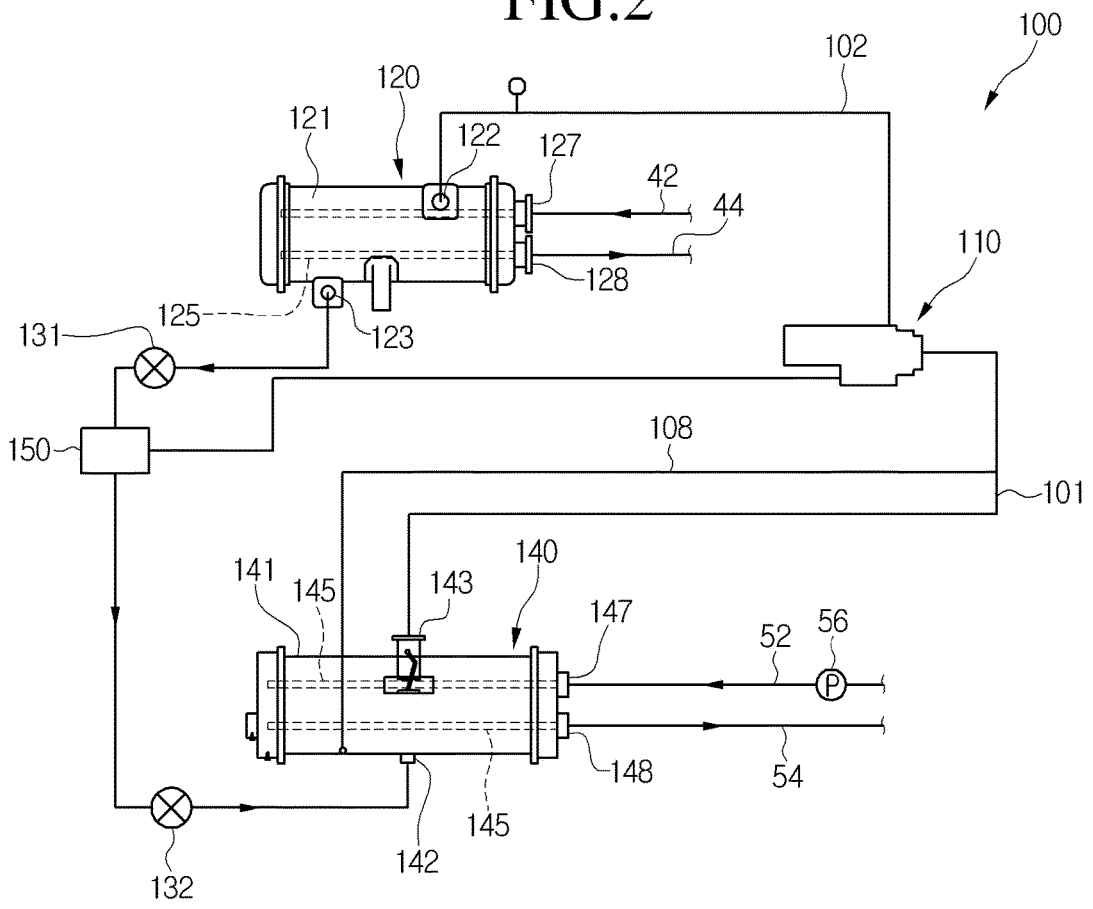
FIG. 2 is a system view of a chiller module according to the first exemplary embodiment.

FIG. 1 is a view of a chiller system according to a first exemplary embodiment, and FIG. 2 is a system view of a chiller module according to the first embodiment.

Referring to FIGS. 1 and 2, a chiller system 10 according to an embodiment includes a chiller module 100 in which a refrigeration cycle is performed, a cooling tower 20 supplying coolant into the chiller module 100, and a cold water customer 30 in which cold water heat-exchanged with the chiller module circulates. The cold water customer 30 may be understood as a device or space in which air-conditioning is performed using cold water.

A coolant circulation passage 40 is disposed between the chiller module 100 and the cooling tower 20. The coolant circulation passage 40 may be understood as a tube for guiding coolant to circulate between the cooling tower 20 and a condenser 120 of the chiller module 100.

The coolant circulation passage 40 includes a coolant inflow passage 42 guiding the coolant so that the coolant is introduced into the condenser 120 and a coolant discharge passage 44 guiding the coolant heated in the condenser 120 to flow into the cooling tower 20.

A coolant pump 46 operating for a flow of the coolant is provided in at least one passage of the coolant inflow passage 42 and the coolant discharge passage 44. For example, in FIG. 1, the coolant pump 46 is provided in the coolant inflow passage 42.

A water discharge temperature sensor 47 detecting a temperature of the coolant introduced into the cooling tower 20 is disposed in the coolant discharge passage 44. Also, a water inflow temperature sensor 48 detecting a temperature of the coolant discharged from the cooling tower 20 is disposed in the coolant inflow passage 42.

A cold water circulation passage 50 is disposed between the chiller module 100 and the cold water customer 30. The cold water circulation passage may be understood as a tube for guiding cold water to circulate between the cold water customer 30 and an evaporator 140 of the chiller module 100.

The cold water circulation passage 50 includes a cold water inflow passage 52 guiding the cold water so that the cold water is introduced into the evaporator 140 and a cold water discharge passage 54 guiding the cold water cooled in the evaporator 140 to flow into the cold water customer 30.

A cold water pump 56 operating for a flow of the cold water is provided in at least one passage of the cold water inflow passage 52 and the cold water discharge passage 54. For example, in FIG. 2, the cold water pump 56 is provided in the cold water inflow passage 52.

The cold water customer 30 may be a water cooling type air conditioner in which air and the cold water are heat-exchanged.

For example, the cold water customer 30 may include at least one unit of an air handing unit in which indoor air and outdoor air are mixed to heat-exchange the mixed air with the cold water, thereby discharging the heat-exchanged air into an indoor space, a fan coil unit (FCU) installed in the indoor space to heat-exchange the indoor air with the cold water, thereby discharging the heat-exchanged air, and a bottom tube unit buried in the bottom within the indoor space.

For example, in FIG. 1, the cold water customer 30 is constituted by the air handing unit.

In detail, the air handing unit includes a casing 61, a cold water coil 62 disposed within the casing 61 to allow the cold water to pass, and blowers 63 and 64 disposed on both sides of the cold water coil 62 to suction the indoor air and outdoor air, thereby blowing the suctioned air into the indoor space.

The blowers 63 and 64 includes a first blower 63 suctioning the indoor air and the outdoor air into the casing 61 and a second blower 64 discharging air-conditioned air to the outside of the casing 61.

An indoor air suction part 65, an indoor air discharge part 66, an external air suction part 67, and an air-conditioned air discharge part 68 are disposed in the casing 61.

When the blowers 63 and 64 operate, a portion of air suctioned from the indoor space through the indoor air suction part 65 is discharged to the indoor air discharge part 66, and remaining air that is not discharged to the indoor air discharge part 66 is mixed with the outdoor air suctioned through the external suction part 67 and heat-exchanged with the cold water coil 62.

Also, the mixed air heat-exchanged (cooled) with the cold water coil 62 may be discharged into the indoor space through the air-conditioned air discharge part 68.

The chiller module 100 includes a compressor 110 compressing a refrigerant, a condenser 120 in which a high-temperature high-pressure refrigerant compressed by the compressor 110 is introduced, expansion devices 131 and 132 decompressing the refrigerant condensed by the condenser 120, and an evaporator 140 evaporating the refrigerant decompressed by the expansion devices 131 and 132.

The expansion devices 131 and 132 includes a first expansion device 131 primarily expanding the refrigerant discharged from the condenser 120 and a second expansion device 132 secondarily expanding the refrigerant separated in an economizer 150.

The chiller module includes a suction tube 101 disposed on an inlet-side of the compressor 110 to guide the refrigerant discharged from the evaporator 140 into the compressor 110 and a discharge tube 102 disposed on an outlet-side of the compressor 110 to guide the refrigerant discharged from the compressor 110 into the condenser 120.

Also, an oil recovery tube 108 guiding oil existing within the evaporator 140 into the suction-side of the compressor 110 is disposed between the evaporator 140 and the compressor 110.

The condenser 120 and the evaporator 140 are provided as a shell and tube type heat exchange device to heat-exchange the refrigerant with water.

In detail, the condenser 120 includes a shell 121 defining an outer appearance thereof, a refrigerant inflow hole 122 defined in one side of the shell 121 to introduce the refrigerant compressed in the compressor 110, and a refrigerant discharge hole 123 defined in the other side of the shell 121 to discharge the refrigerant condensed in the condenser 120. The shell 121 may have an approximately cylindrical shape.

The condenser 120 includes a coolant tube 125 disposed within the shell 121 to guide a flow of the coolant, a coolant inflow part 127 disposed on one side of an end of the shell 121 to introduce the coolant into the coolant tube 125, and a coolant discharge part 128 disposed on the other side of an end of the shell 121 to discharge the coolant from the coolant tube 125.

The coolant flows into the coolant tube 125 and is heat-exchanged with the refrigerant within the shell 121, which is introduced through the refrigerant inflow hole 122. The coolant tube 125 may be called a "coolant electric-heating tube" The coolant inflow part 127 is connected to the coolant inflow passage 42, and the coolant discharge part 128 is connected to the coolant discharge passage 44.

The economizer 150 is disposed on a refrigerant discharge-side of the condenser 120. The first expansion device 131 is disposed on an inlet-side of the economizer 150. The refrigerant condensed in the condenser 120 is primarily decompressed in the first expansion device 131 and then introduced into the economizer 150.

The economizer 150 may be understood as a component for separating a liquid refrigerant and a gas refrigerant of the primarily decompressed refrigerant. The separated refrigerant may be introduced into the compressor 110, and the separated liquid refrigerant may be introduced into the second expansion device 132 and then secondarily decompressed.

In detail, the evaporator 140 includes a shell 141 defining an outer appearance thereof, a refrigerant inflow hole 142 defined in one side of the shell 141 to introduce the refrigerant expanded in the second expansion device 132, and a refrigerant discharge hole 143 defined in the other side of the shell 141 to discharge the refrigerant evaporated in the evaporator 140. The refrigerant discharge hole 143 may be connected to the suction tube 101.

The evaporator 140 includes a cold water tube 145 disposed within the shell 141 to guide a flow of the cold water, a cold water inflow part 147 disposed on one side of an end of the shell 141 to introduce the cold water into the cold water tube 145, and a cold water discharge part 148 disposed on the other side of an end of the shell 141 to discharge the cold water from the cold water tube 145.

The cold water flows into the cold water tube 145 and is heat-exchanged with the refrigerant within the shell 141, which is introduced through the refrigerant inflow hole 142. The cold water tube 145 may be called a "cold water electric-heating tube." The cold water inflow part 147 is connected to the cold water inflow passage 52, and the cold water discharge part 148 is connected to the cold water discharge passage 54.

The coolant inflow part 127 and the cold water inflow part may be called "inflow parts," and the coolant discharge part 128 and the cold water discharge part 148 may be called "discharge parts." Also, the coolant tube 125 and the cold water tube 145 may be commonly called a "water tube."

Hereinafter, a constitution and operation of a module assembly including at least one chiller module 100 will be described with reference to the accompanying drawings.

Figure 3:
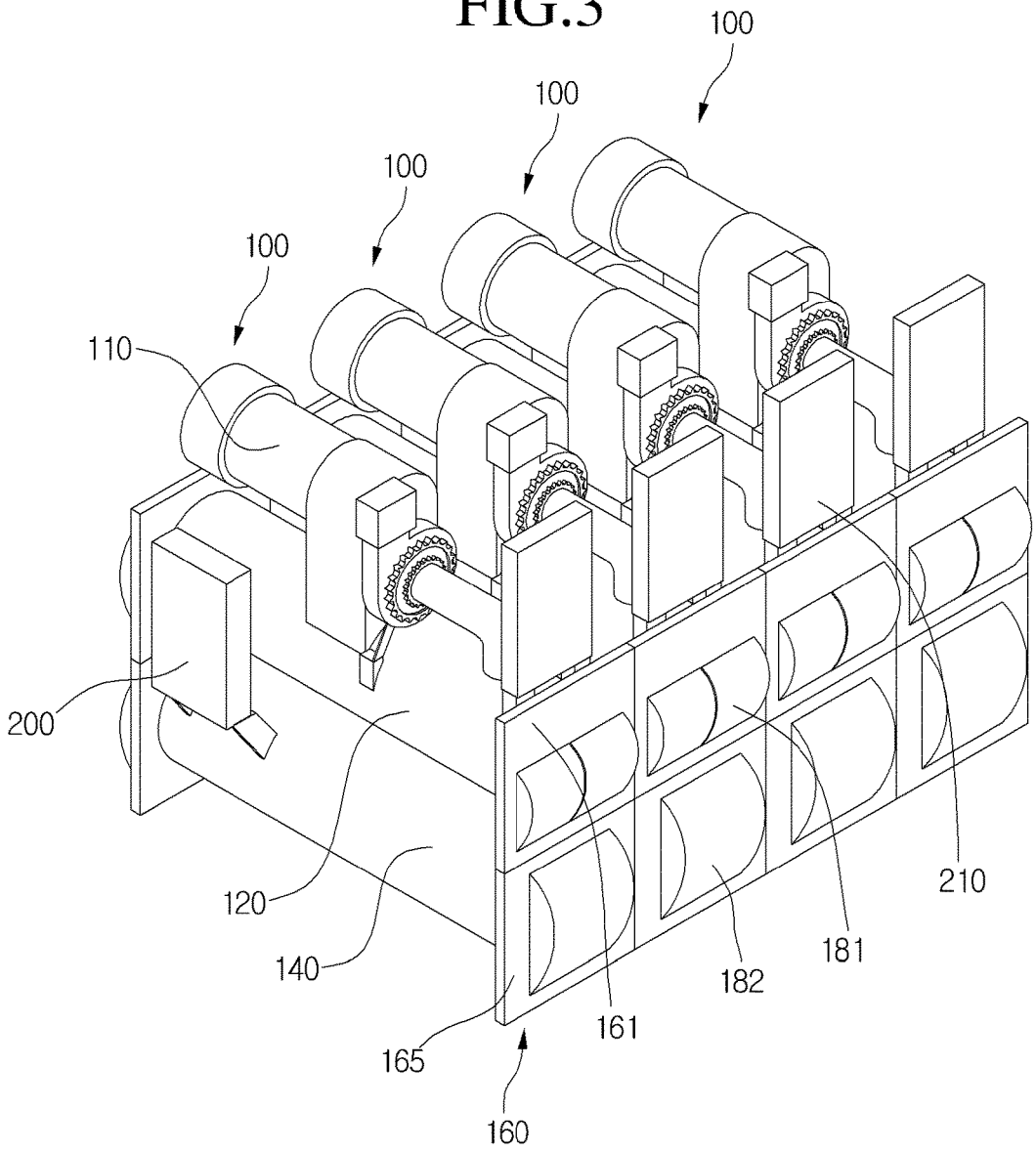
FIGS. 3 to 5 are views of a module assembly according to the first exemplary embodiment.
Figure 4:
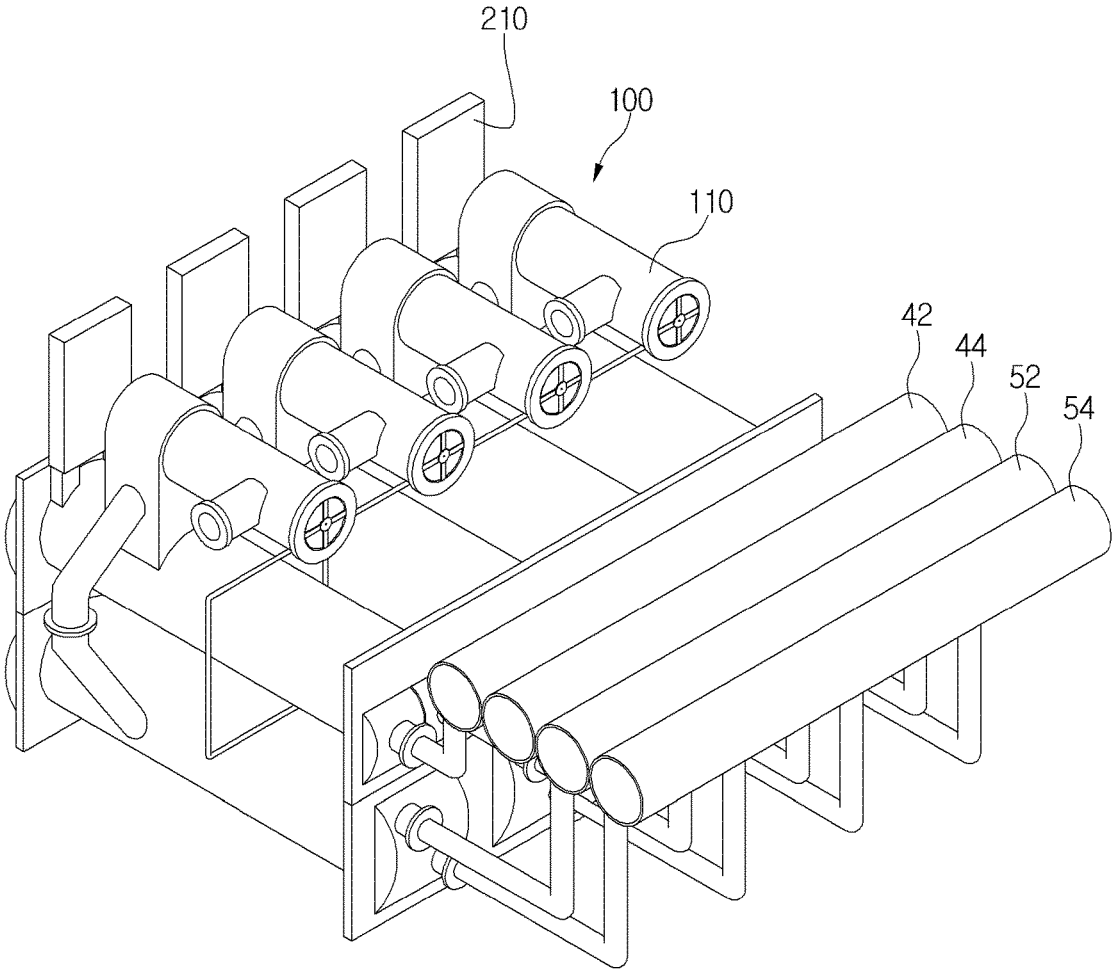
Figure 5:
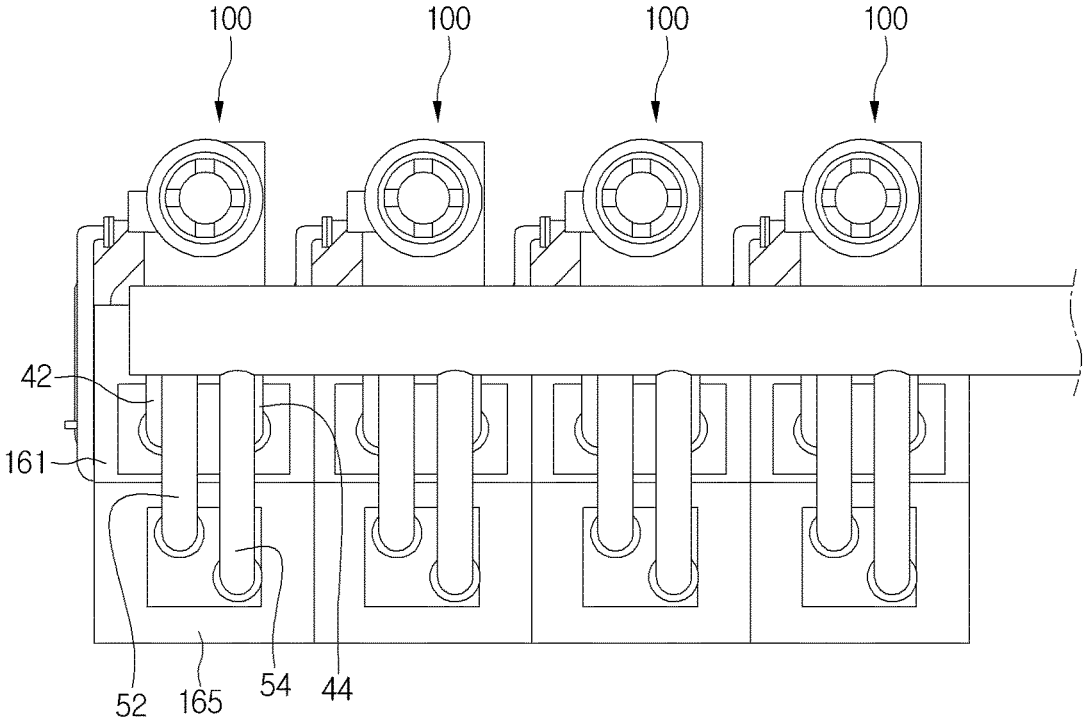
Figure 6:
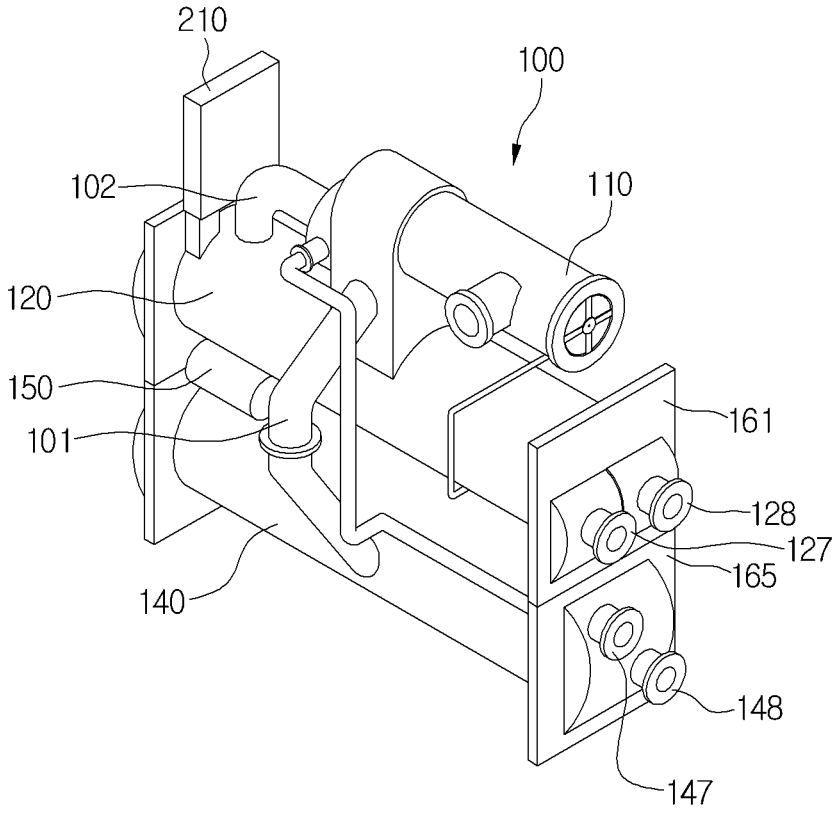
FIG. 6 is a view of the chiller module according to the first exemplary embodiment.

FIGS. 3 to 5 are views of a module assembly according to the first embodiment, and FIG. 6 is a view of the chiller module according to the first embodiment.

Referring to FIGS. 3 to 7, a module assembly according to a first embodiment includes a plurality of chiller modules 100. As shown in FIG. 2, each of the chiller modules 100 may perform an independent refrigeration cycle and have the same refrigeration ability.

On the basis of the refrigeration ability required for the chiller system, the module assembly may include at least one chiller module 100. For example, in the drawings, four (even number) chiller modules 100 are coupled to each other to constitute the module assembly.

If it is assumed that one chiller module 100 has refrigeration ability of about 500 RT, it may be understood that the chiller system according to the first embodiment has refrigeration ability of about 2,000 RT through four chiller modules. However, the current embodiment is not limited to the number of chiller modules constituting the module assembly.

Each of the chiller modules 100 includes a compressor 110, a condenser 120, and an evaporator 140. The condenser 120 may be disposed above the evaporator 140, and the compressor 110 may be disposed above the condenser 120.

The chiller module 100 includes a discharge tube 102 extending downward from the compressor 110 and connected to the condenser 120 and a suction tube 101 extending upward from the evaporator 140 and connected to the compressor 110. Also, an economizer 150 may be disposed on an approximate point between the condenser 120 and the evaporator 140.

The chiller module 100 includes a support 160 supporting at least one side of the condenser 120 and the evaporator 140. For example, the support 160 is configured to support both sides of the condenser 120 and the evaporator 140.

The support 160 includes a condenser support 161 supporting both sides of the condenser 120 and an evaporator support 165 supporting both sides of the evaporator 140. The evaporator support 165 is disposed below the condenser support 161.

The plurality of chiller modules 100 may be coupled to each other. The supports of the chiller modules 100 may be coupled to each other state in the state where the plurality of chiller modules 100 is coupled to each other. That is, the condenser support 161 and the evaporator support 165 of one chiller module 100 may be coupled to the condenser support 161 and the evaporator support 165 of the other chiller module 100 adjacent to the one chiller module 100, respectively.

A plurality of passages guiding a flow of coolant or cold water is disposed in a side of the chiller module 100. The plurality of passage include a coolant inflow passage 42, a coolant discharge passage 44, a cold water inflow passage 52, and a cold water discharge passage 54.

The coolant inlet 127 connected to the coolant inflow passage 42 and a coolant outlet 128 connected to the coolant discharge passage 44 are disposed on one support 161 of the condenser supports 161 disposed on both sides of the chiller module 100.

Also, the cold water inlet 147 connected to the cold water inflow passage 52 and a cold water outlet 148 connected to the cold water discharge passage 54 are disposed on one support 161 of the evaporator supports 165 disposed on both sides of the chiller module 100.

The coolant flowing into the coolant inflow passage 42 is introduced into the condenser 120 of the at least one chiller module 100 of the plurality of chiller modules 100. Also, the coolant heat-exchanged in the condenser 120 of each of the chiller modules 100 may be discharged through the coolant discharge passage 44.

The cold water flowing into the cold water inflow passage 52 is introduced into the evaporator 140 of the at least one chiller module 100 of the plurality of chiller modules 100. Also, the cold water heat-exchanged in the evaporator 140 of each of the chiller modules 100 may be discharged through the cold water discharge passage 54.

Caps 181 and 182 each providing a flow space of the coolant or cold water are disposed on the other side of the chiller module 100. The caps 181 and 182 may be disposed on the supports 161 and 165 disposed on sides opposite to the supports disposed on the coolant inlet and outlet 127 and 128 and the cold water inlet and outlet 147 and 148.

In detail, the caps 181 and 182 include a condenser cap 181 disposed on an end of the condenser 120 and an evaporator cap 182 disposed on an end of the evaporator 140.

The condenser cap 181 may switch a flow direction of the coolant passing through the condenser 120. For example, the coolant passing through a portion of the coolant tube 125 of the condenser 120 of one chiller module 100 may flow into the condenser cap 181 and then is introduced again into the remaining coolant tubes 125 of the condenser 120, thereby being heat-exchanged.

The evaporator cap 182 may switch a flow direction of the cold water passing through the evaporator 120. For example, the cold water passing through a portion of the cold water tube 145 of the evaporator of one chiller module 100 may flow into the evaporator cap 182 and then is introduced again into the remaining cold water tube 145 of the evaporator 140, thereby being heat-exchanged.

The module assembly includes a control device controlling operations of the plurality of chiller modules 100.

The control device includes a main control device 200 controlling an operation of the chiller module according to a required refrigeration load or an operation load of the chiller module and a plurality of module control devices 210 respectively disposed on the chiller modules 100 to receive an operation signal from the main control device 200, thereby controlling an operation of each of the chiller module 100. The main control device 200 and the module control device 210 may be commonly called a "control device".

The plurality of module control devices 210 may be disposed on the supports 160 of the chiller modules 100, respectively. Also, the main control device 200 may be disposed on one chiller module of the plurality of chiller modules 100 constituting the module assembly.

Hereinafter, an inner structure of the chiller module 100 will be described in detail.

Figure 7:
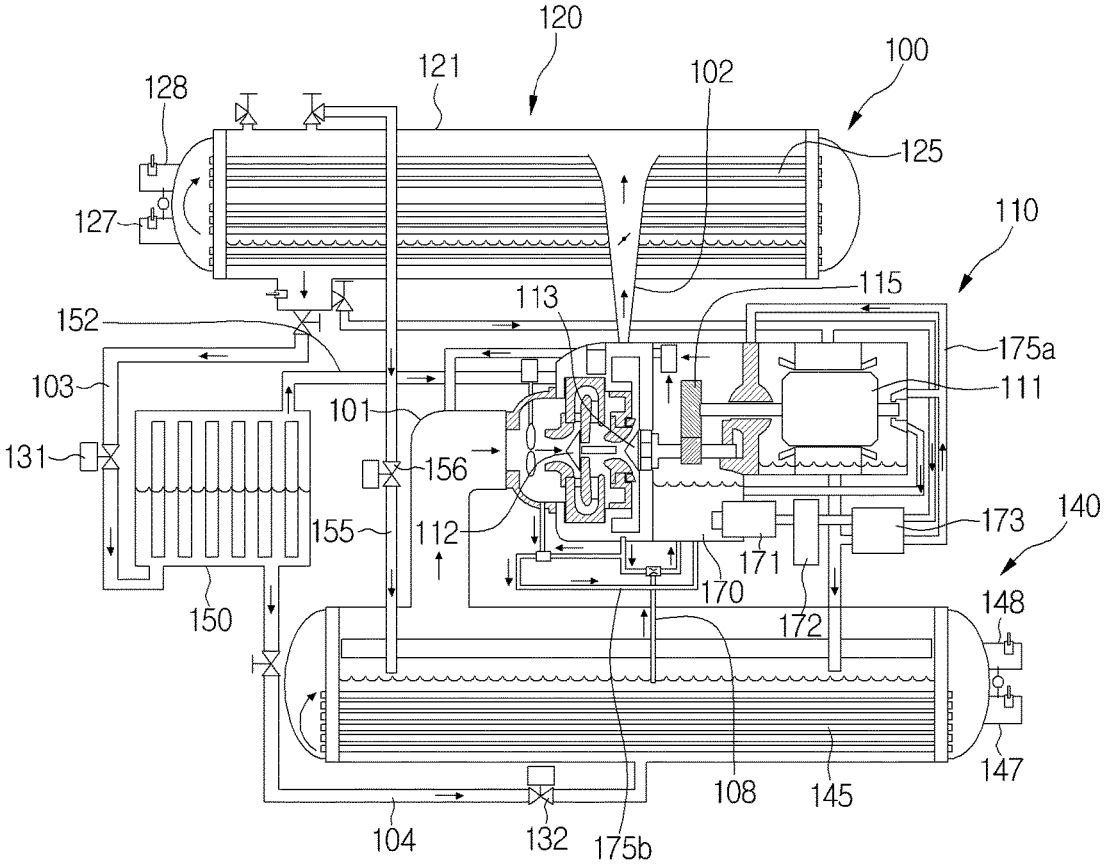
FIG. 7 is a system view of a refrigeration cycle with respect to the chiller module according to the first exemplary embodiment.

FIG. 7 is a system view of a refrigeration cycle with respect to the chiller module according to the first embodiment.

Referring to FIG. 7, the chiller module 100 according to the first embodiment includes a compressor 110, a condenser 120, a first expansion device 131, an economizer 150 (second expansion device), and an evaporator 140. The chiller module 100 according to the current embodiment may be understood as a two-stage compression type chiller device.

The refrigerant compressed in the compressor 110 is introduced into the condenser 120. A bypass tube 155 bypassing the refrigerant of the condenser 120 into the evaporator 140 is disposed on a side of the condenser 120. Also, a bypass valve 156 for adjusting a flow rate of the refrigerant is disposed in the bypass tube 155.

The refrigerant condensed in the condenser 120 flows through a condenser outlet tube 103 and is expanded in the first expansion device 131 to flow into the economize 150.

A gas refrigerant separated in the economizer 150 is introduced into the compressor 110 through a gas refrigerant inflow tube 152. The gas refrigerant inflow tube 152 extends from a side of the economizer 150 toward the compressor 110.

Also, a liquid refrigerant separated in the economizer 150 is introduced into the evaporator 140 through the evaporator inlet tube 104. Also, the refrigerant evaporated in the evaporator 140 is introduced into the compressor 110 through the suction tube 101.

Oil within the evaporator 140 may be recovered into an oil sump 170 through an oil recovery tube 108.

In detail, the oil sump 170 in which the oil is stored is disposed inside the compressor 110. Also, an oil passage guiding a flow of the oil is disposed in the vicinity of the compressor 110.

The oil passage includes a first supply passage **175*a* for supplying the oil stored in the oil sump 170 toward a motor 111 and a sump passage 175*b* for introducing the oil within the compressor 110 or the oil within the evaporator 140 into the oil sump 170**.

The sump passage **175*b* extends outward from one side of the compressor 110 and is connected to the other side of the compressor 110. Also, the oil recovery tube 108 is connected to the sump passage 170. Thus, the oil within the compressor 110 and the oil within the evaporator 140 may be recovered into the oil sump 170 through the sump passage 175*b***.

The compressor 110 includes an oil pump 171 operating to allow the oil to circulate the oil into the compressor 110 and the evaporator 140, a filter 172 filtering foreign substances from the oil passing through the oil pump 171, and an oil cooler 173 cooling the circulating oil.

The compressor 110 may be a centrifugal turbo compressor.

In detail, the compressor 110 includes a motor 111 generating a driving force, a plurality of impellers 112 and 113 rotatable by using a rotation force of the motor 111, and a gear assembly 115 transmitting the rotation force of the motor 111 into the impellers 112 and 113.

The gear assembly 115 may be coupled to a rotation shaft of the motor 111 and a shaft of the plurality of impellers 112 and 113.

The plurality of impellers 112 and 113 include first and second impellers 112 and 113 which are rotatable. The first and second impellers 112 and 113 may be understood as components which increase a flow rate of the refrigerant and compress the refrigerant to a high-pressure by using a centrifugal force thereof.

The first impeller 112 may primarily compress the refrigerant suctioned through the suction tube 101, and the second impeller 113 may secondarily compress the refrigerant passing through the first impeller 112 and the gas refrigerant separated in the economizer 150.

The high-pressure refrigerant compressed while passing through the first and second impellers 112 and 113 may be introduced into the condenser 120 through the discharge tube 102.

Figure 8:
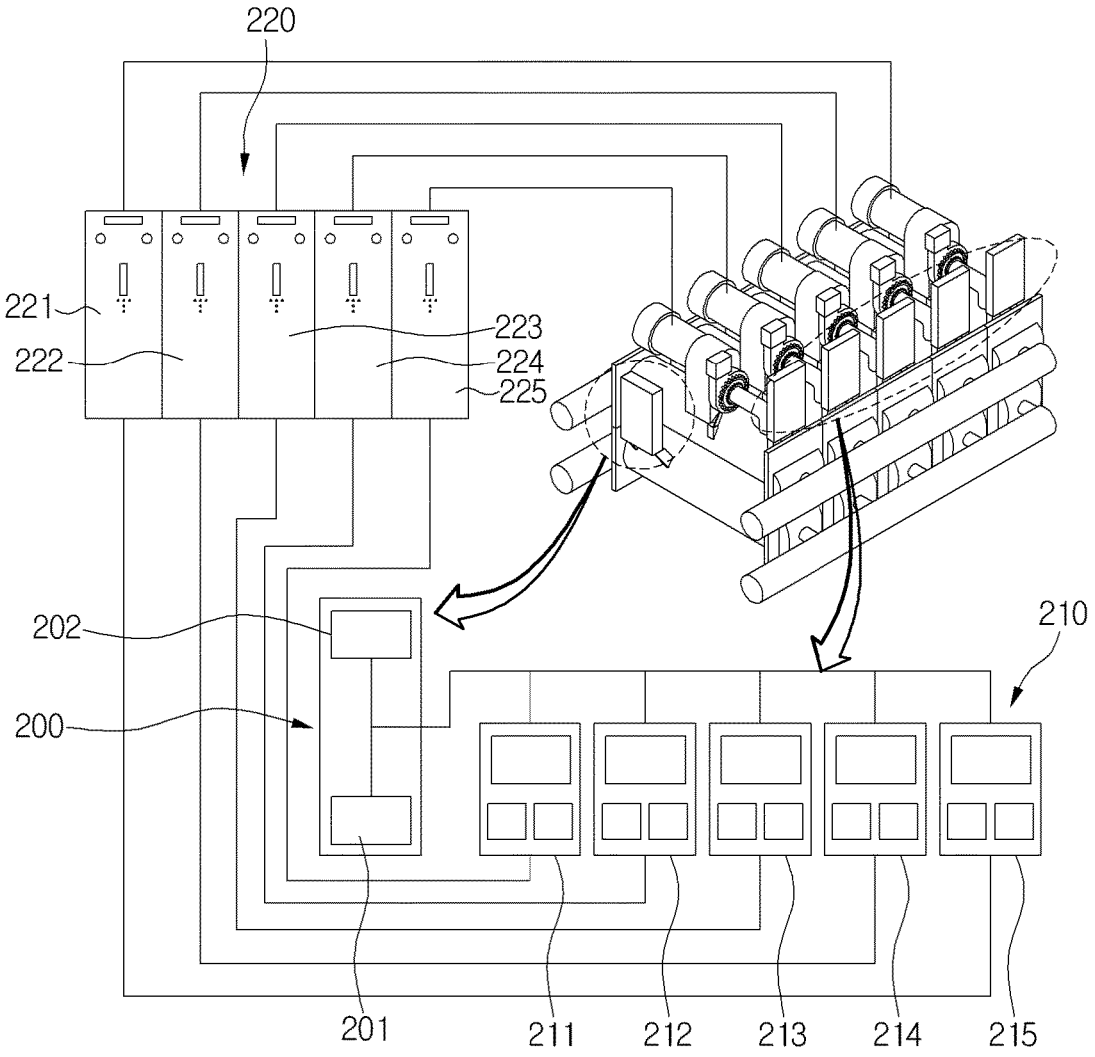
FIG. 8 is a view of a state in which the module assembly is driven by a plurality of starting devices according to the first exemplary embodiment.
Figure 9:
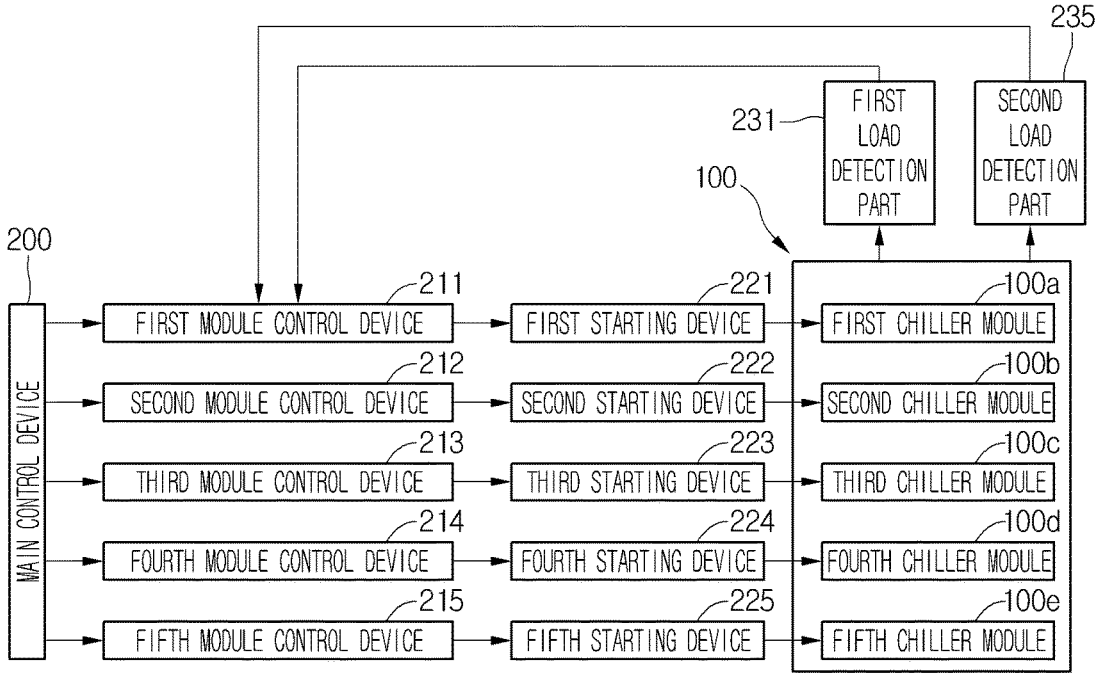
FIG. 9 is a block diagram illustrating a portion of the chiller system according to the first exemplary embodiment.

FIG. 8 is a view of a state in which the module assembly is driven by a plurality of starting devices according to the first embodiment, and FIG. 9 is a block diagram illustrating a portion of the chiller system according to the first embodiment.

Referring to FIGS. 8 and 9, the chiller system according to the first embodiment includes the module assembly constituted by the plurality of chiller modules 100. For example, in the drawings, five chiller modules are coupled to each other. Hereinafter, the chiller system will be described on the basis of the contents disclosed in the drawings. However, the current embodiment is not limited to the number of chiller modules coupled to each other.

The chiller system includes a main control device 200 controlling an operation of the module assembly, a module control device 210 provided in each of the chiller modules 100 to control an operation of the chiller module 100 on the basis of a signal transmitted from the main control device 200, and a starting device 220 serving as a switching device and communicably connected to the module control device 210 to apply a power into the chiller module 100.

The plurality of chiller modules 100 include a first chiller module 100*a*, a second chiller module 100*b*, a third chiller module 100*c*, a fourth chiller module 100*d*, and a fifth chiller module 100*e*.

The module control device 210 includes a first chiller module control device 211, a second chiller module control device 212, a third chiller module control device 213, a fourth chiller module control device 214, and a fifth chiller module control device 215.

Also, the starting device 220 includes a first starting device 221, a second starting device 222, a third starting device 223, a fourth starting device 224, and a fifth starting device 225 which are respectively connected to the plurality of module control devices.

The main control device 200 includes an input unit 201 inputting a predetermined command for operating the module assembly and a display unit 202 displaying an operation state of the module assembly.

The main control device 200 controls operations of the plurality of module control devices 210 on the basis of load information of the chiller system. The load information of the chiller system includes a temperature load of cold water passing through the chiller module 100 and an operation load of a compressor 110.

In detail, the chiller system includes load detection parts 231 and 235 detecting load information of the system. The load detection parts 231 and 235 include a first load detection part 231 detecting temperature information of the cold water and a second load detection part 235 detecting operation load information of the compressor 110. A set of the first load detection part 231 and the second load detection part 235 is provided in the chiller module 100, respectively, or provided in the chiller system.

The first load detection part 231 includes a temperature sensor detecting a temperature (a cold water inlet temperature) of cold water introduced into the chiller module 100.

The main control device 200 may determine whether how many chiller modules of the plurality of chiller modules operate on the basis of a difference value between the detected cold water inlet temperature and a preset cold water outlet temperature. Here, the cold water outlet temperature may be a discharge temperature of the cold water heat-exchanged in the chiller module 100.

For example, if the difference value between the detected cold water inlet temperature and the preset cold water outlet temperature is large, it may be recognized that a temperature load of the cold water is large. Thus, the number of operating chiller modules 100 may increase. However, if the difference value is small, it may be recognized that the temperature load of the cold water is small. Thus, the number of operating chiller modules 100 may decrease.

The second load detection part 235 may include a refrigerant amount detection part detecting an amount of refrigerant introduced into the compressor 110 or a current detection part detecting current information applied to the compressor 110. For example, the refrigerant amount detection part may be a valve device or inlet guide vane of which an opened degree is adjusted according to an amount of refrigerant.

The main control device 200 may determine whether how many chiller modules of the plurality of chiller modules operate on the basis of whether a current value detected in the current detection part is greater than a preset current value.

For example, if the current value detected in the current detection part is greater than the preset current value, it may be recognized that the operation load of the compressor is large. Thus, the number of operating chiller modules 100 may be maintained or increased. On the other hand, if the current value detected in the current detection part is less than the preset current value, it may be recognized that the operation load of the compressor is small. Thus, the number of operating chiller modules 100 may decrease.

The main control device 200 may determine whether how many chiller modules of the plurality of chiller modules operate on the basis of whether the refrigerant amount detected in the refrigerant amount detection part is greater than a preset refrigerant amount.

If the refrigerant amount detected in the refrigerant amount detection part is greater than the preset refrigerant amount, the number of operating chiller modules 100 may increase. On the other hand, if the refrigerant amount detected in the refrigerant amount detection part is less than the preset refrigerant amount, the number of operating chiller modules 100 may decrease.

The load information detected in the first or second load detection part 231 and 235 may be transmitted into the module control devices 211, 212, 213, 214, and 215. The main control device 200 may control the number of operating chiller modules on the basis of the detected load information. Of course, the detected load information may be directly transmitted into the main control device 200.

For example, if three chiller modules of the five chiller modules are operating, and it is recognized that the system load increases, the main control device 200 may transmit a signal for operating at least one chiller module of the two chiller modules that do not operate into the corresponding module control device.

On the other hand, if it is recognized that the system load decreases, the main control device 200 may transmit a signal for stopping an operation of the at least one chiller module of the three operating chiller modules into the corresponding module control device.

When each of the module control devices 211, 212, 213, 214, and 215 receives the signal with respect to the operation thereof from the main control device 200, each of the module control devices 211, 212, 213, 214, and 215 controls an on/off operation of the corresponding starting devices 221, 222, 223, 224, and 225 to control the operation of each of the chiller modules 100. For example, the module control device 210 may adjust a current or frequency applied to the motor 111, or adjust an amount of refrigerant introduced into the compressor 110 to reach the preset cold water outlet temperature.

Figure 10:
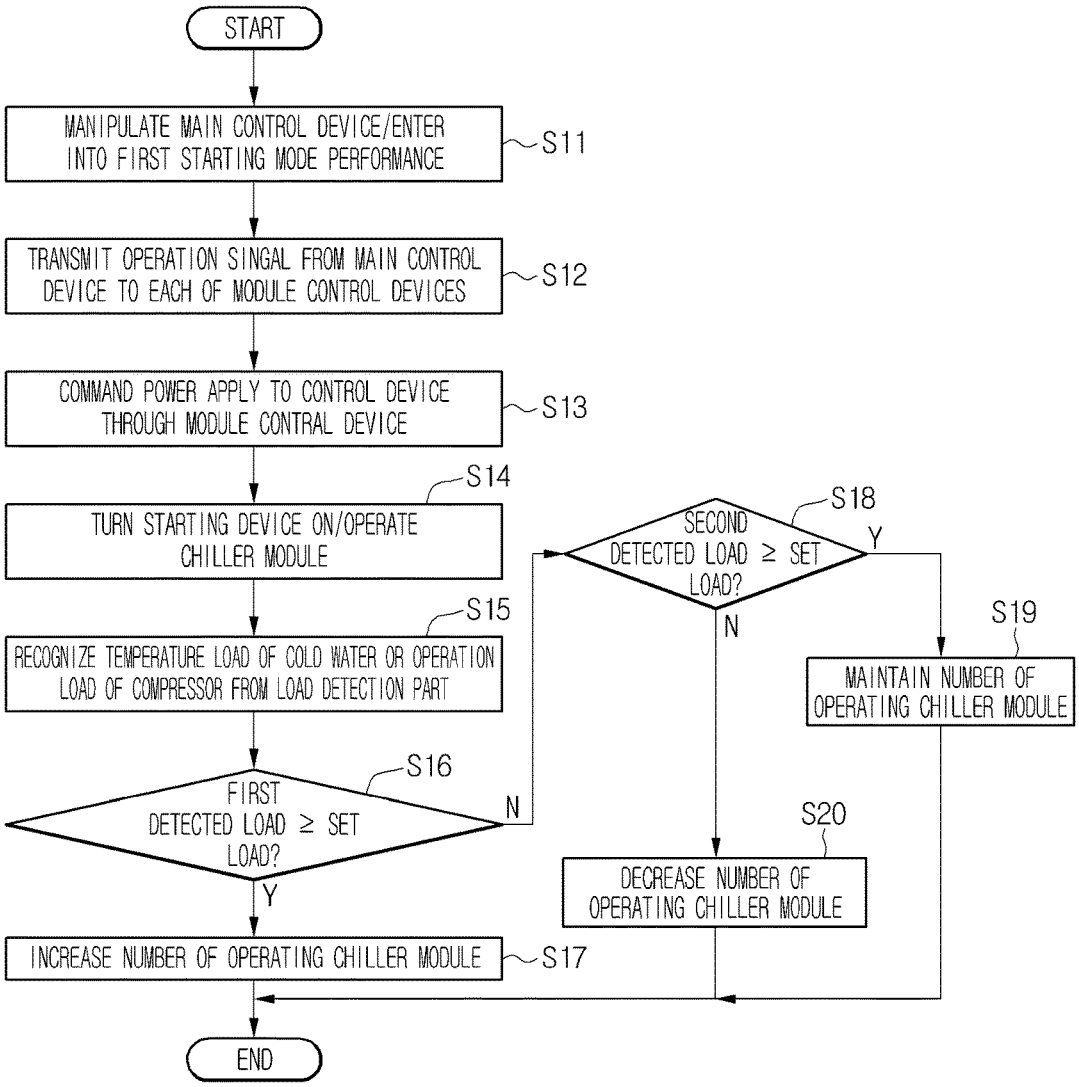
FIG. 10 is a flowchart illustrating a control method of the chiller system according to the first exemplary embodiment.

FIG. 10 is a flowchart illustrating a control method of the chiller system according to the first embodiment. Referring to FIG. 10, a control method according to a first embodiment will be described.

First, the main control device 200 is manipulated to start performance of a first starting mode (S11). Here, the first starting mode may be understood as a starting mode for controlling an operation of the chiller module 100 through the plurality of module control devices 210 and the plurality of starting devices 220.

Also, while the performance of the first starting mode is started, the number of operating chiller modules of the plurality of chiller modules 100 may be determined on the basis of an operation load of the chiller system.

When the first starting mode is performed, an operation signal may be transmitted into the module control devices 211, 212, 213, 214, and 215 of the operating chiller modules from the main control device 200. The operation signal may include a signal with respect to the operation of the chiller module 100 (S12).

The corresponding module control device 210 of the chiller module to which an operation command is applied may transmit a power apply command into the starting device 220 (S13).

Also, the starting device 220 may turn a switch on to operate the corresponding chiller module 100. For example, if it is determined that thee chiller modules should operate in the operation S11, the starting devices 200 corresponding to the three chiller modules may be turned on at the same time (S14).

While the chiller module 100 operates, the operation load of the chiller system may be detected from the load detection parts 231 and 235. The operation load may include a temperature load of the cold water or an operation load of the compressor 110.

Also, the operation load of the compressor 110 may be determined on the basis of information with respect to an amount of refrigerant introduced into the compressor 110 or current information applied to the compressor 110 (S15).

It is determined whether the load information detected in the load detection parts 231 and 235 is greater than a first set load (S16). When the detected load information is greater than or equal to the first set load, the number of operating chiller modules 100 may increase. When the number of operating chiller modules 100 increases, the module control device 210 may turn at least one starting device 220 on to operate the corresponding chiller module 100 (S17).

When the detected load information is less than the first set load in the operation S16, whether the detected load information is greater than a second set load is recognized (S18). Also, when the detected load information is greater than or equal to the second set load, the number of operating chiller modules 100 may be maintained (S19).

On the other hand, when the detected load information is less than the second set load, the number of operating chiller modules 100 may decrease. When the number of operating chiller modules 100 decreases, the module control device 210 may turn at least one starting device 220 off to stop the operation of the corresponding chiller module 100 (S20).

As described above, since the starting device disposed on each of the chiller modules is controllable according to the load information of the chiller system, the control of the operation of the chiller module may be effectively performed.

Hereinafter, a second exemplary embodiment will be described. The second embodiment is equal to the first embodiment except a control configuration and method of the chiller system. Thus, their different points may be mainly described, and also, the same parts as those of the first embodiment will be denoted by the same description and reference numeral of the first embodiment.

Figure 11:
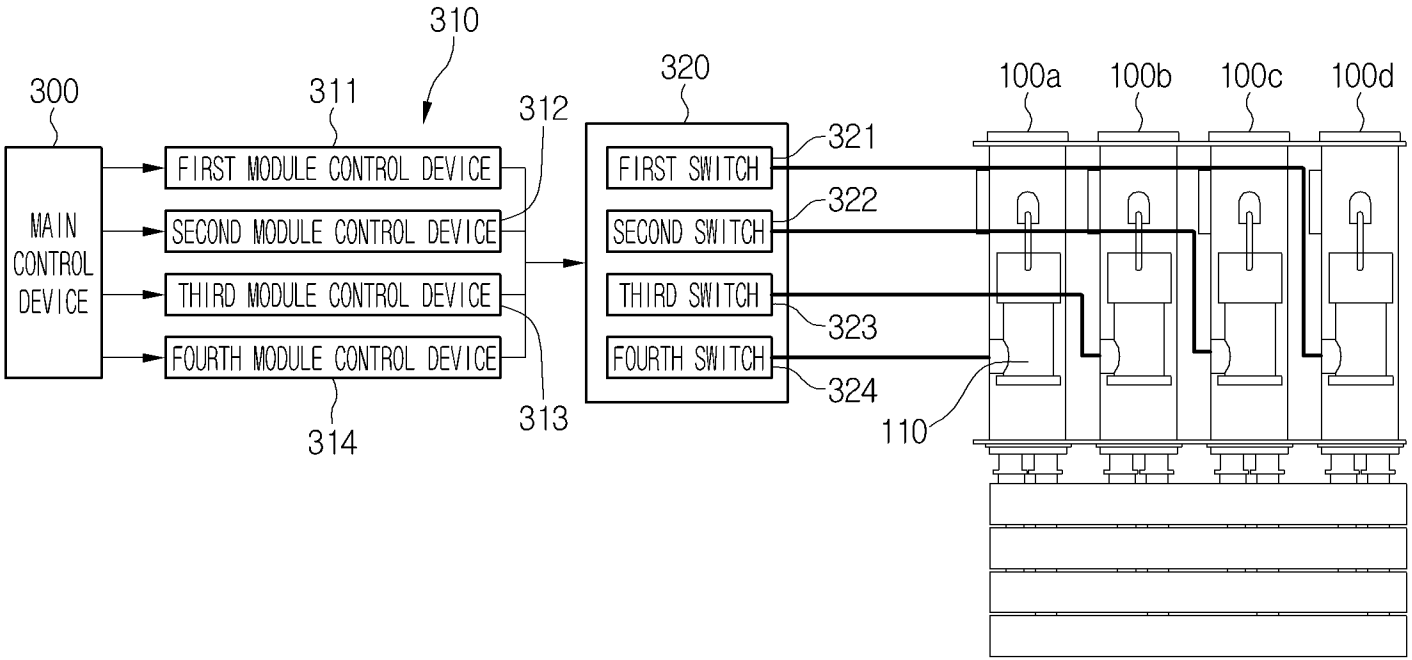
FIG. 11 is a block diagram of a state in which a module assembly is driven by one starting device according to a second exemplary embodiment.
Figure 12:
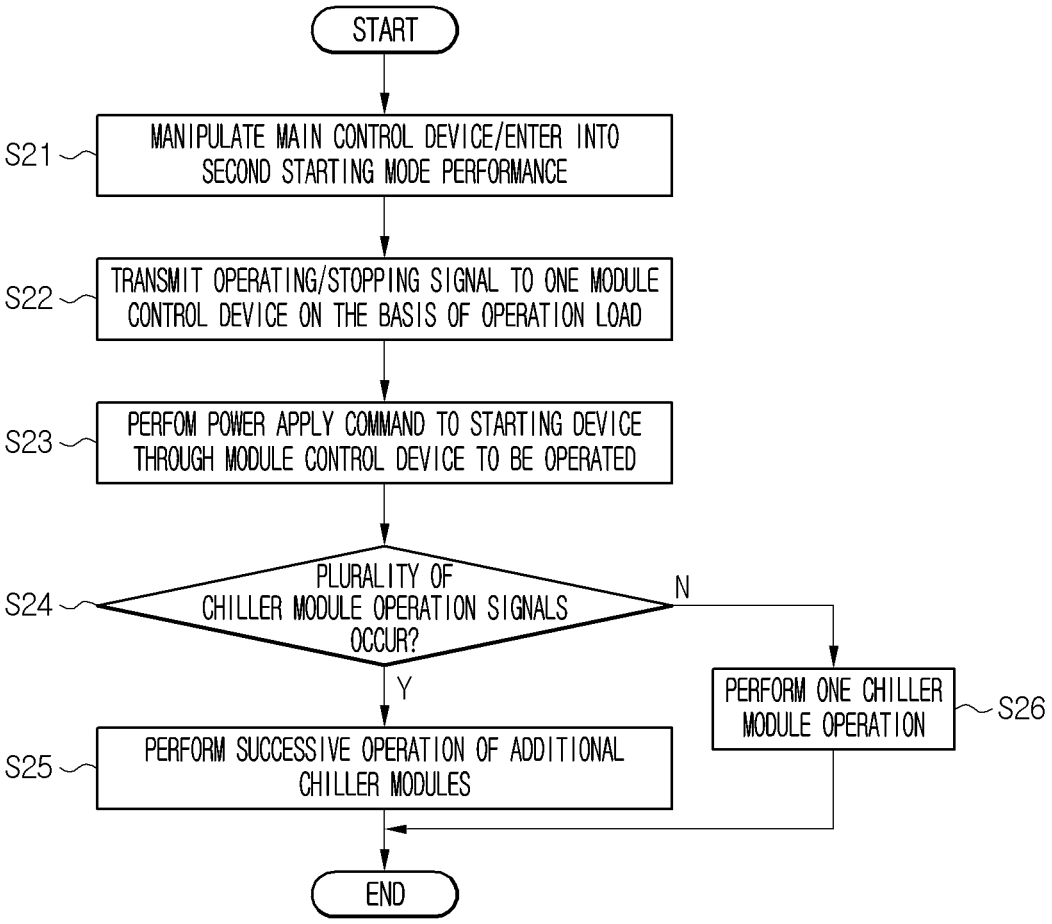
FIG. 12 is a flowchart illustrating a control method of a chiller system according to the second exemplary embodiment.
Figure 13:
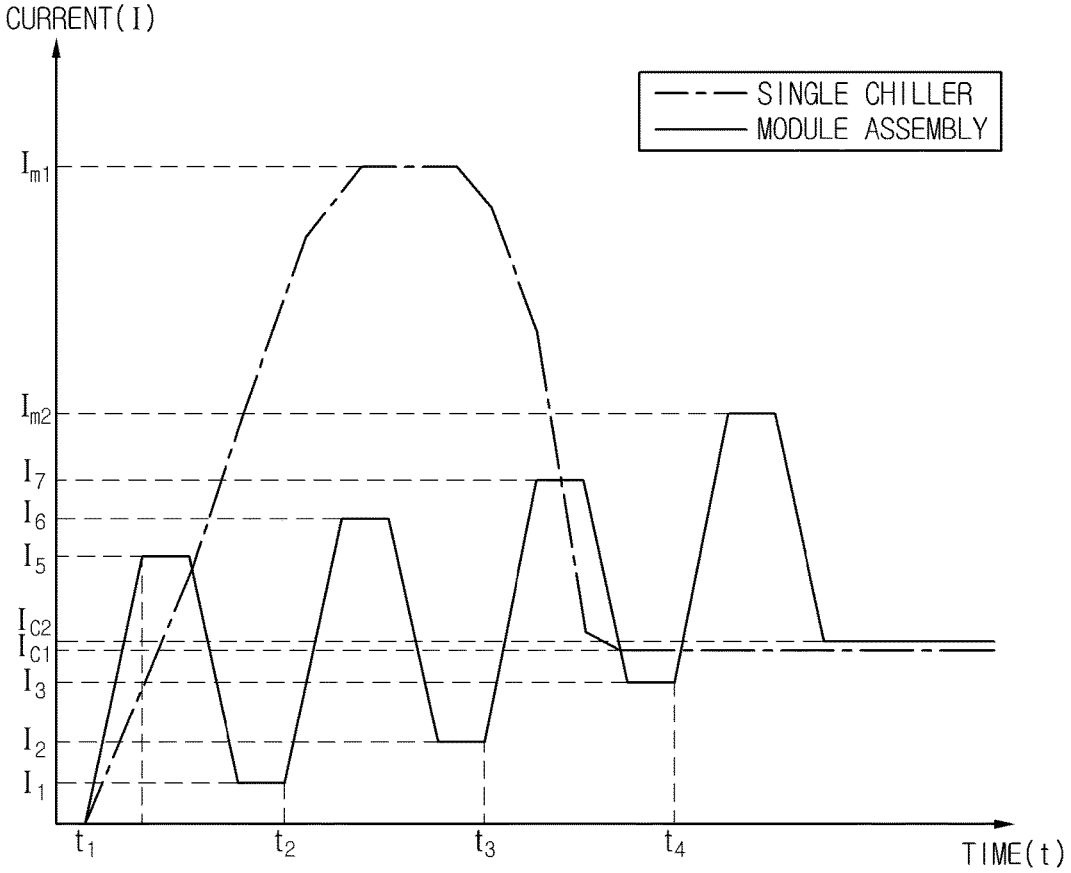
FIG. 13 is a graph of a change of a starting current when the chiller system operates according to the second exemplary embodiment.

FIG. 11 is a block diagram of a state in which a module assembly is driven by one starting device according to a second embodiment, FIG. 12 is a flowchart illustrating a control method of a chiller system according to the second embodiment, and FIG. 13 is a graph of a change of a starting current when the chiller system operates according to the second embodiment.

Referring to FIG. 11, whether a plurality of chiller modules 100*a*, 100*b*, 100*c*, and 100*d* according to a second embodiment operate may be controlled by one starting device 320. In the current embodiment, for example, a module assembly includes four chiller modules 100*a*, 100*b*, 100*c*, and 100*d*. However, the current embodiment is not limited to the number of chiller modules.

In detail, the chiller system according to the current embodiment includes a main control device 300, a plurality of module control devices 311, 312, 313, and 314 communicably connected to the main control device 300, and one starting device 320 receiving an operation signal from the module control devices 311, 312, 313, and 314. Descriptions with respect to the main control device 300 and the plurality of module control devices 311, 312, 313, and 314 will be denoted by those of the first embodiment.

The starting device 320 includes a plurality of switches 321, 322, 323, and 324 selectively turned on/off to apply a power to the plurality of chiller modules 100*a*, 100*b*, 100*c*, and 100*d*. The plurality of switches 321, 322, 323, and 324 may be understood as "contact members" for starting operations of a plurality of motors 111 provided to the plurality of chiller modules 100*a*, 100*b*, 100*c*, and 100*d*.

The plurality of switches 321, 322, 323, and 324 include a first switch 321 connected to the first chiller module 100*a*, a second switch 322 connected to the second chiller module 100*b*, a third switch 323 connected to the third chiller module 100*c*, and a fourth switch 324 connected to the fourth chiller module 100*d*.

The plurality of chiller modules according to the current embodiment may be successively started in operation. Here, the starting order of the chiller modules may be previously decided.

The main control device 300 may selectively transmit an operation signal of the chiller module to the module control devices 311, 312, 313, and 314 so that the chiller modules are started one by one on the basis of refrigeration ability required for the system.

For example, if ability of each of chiller modules is about 500 RT, the refrigeration ability required for the chiller system, i.e., when the operation load of the chiller system is about 1,500 RT, it may be necessary to start three chiller modules.

Here, the main control device may successively request an operation start of the chiller modules to the three module control devices on the basis of the preset order.

In a state where the three chiller modules are operating, as shown in the first embodiment, the number of operating chiller modules may be maintained, increase or decrease on the basis of the system load detected by the load detection part, i.e., the cold water temperature load or the compressor operation load. Related descriptions will be denoted by the first embodiment.

Referring to FIG. 12, a control method of the chiller system according to the current embodiment will be described below.

First, the main control device 300 is manipulated to start a second starting mode (S21). Here, the second starting mode may be understood as a starting mode for controlling an operation of the chiller module 100 through the plurality of module control devices 310 and one starting devices 320.

Also, while the performance of the second starting mode is started, the number of operating chiller modules of the plurality of chiller modules 100 may be decided on the basis of an operation load of the chiller system.

When the second starting mode is performed, an operation signal may be transmitted into each of the module control devices 311, 312, 313, and 314 on the basis of the operation load of the chiller system. The operation signal may include a signal with respect to the operation or operation stop of the chiller module 100 (S22).

The corresponding module control device 310 of the chiller module to which an operation command is applied may transmit a power apply command into the starting device 320 (S23). Here, the switches 321, 322, 323, and 324 connected to the operating chiller modules 100 may be turned on, and thus, one chiller module 100 may be started in operation.

Also, it is recognized whether an operation of an additional chiller module 100 is required, i.e., whether an operation signal with respect to the plurality of chiller modules 100 occurs. That is, it is recognized whether the operation signal with respect to the chiller modules to be operated decided while the performance of the second starting mode is started occurs.

When the operation signal with respect to the plurality of chiller modules 100 occurs, the starting of the other chiller module 100 may be performed according to the preset order. Here, the switches 321, 322, 323, and 324 connected to the chiller modules 100 to be operated may be turned on.

For example, when a command signal for operating the three chiller modules 100 occurs from the main control device 300, the module control devices corresponding to first, second, and third-ranks of the module control devices 310 may successively turn the switches 321, 322, 323, and 324 of the starting device 320 on.

When the signal for operating the plurality of chiller modules 100 does not occur in the operation S24, only one chiller module 100 started in the operation S23 may be maintained (S26).

As described above, since the chiller modules are successively started according to the required load of the system, an unnecessary operation of the chiller module may be prevented to reduce power consumption and improve reliability of the system.

FIG. 13 illustrates the trends of current values consumed in a single chiller according to a related art and the module assembly according to the current embodiment while the chiller device is started.

The single chiller according to the related art represents one chiller unit having specific refrigeration ability, and the module assembly according to the current embodiment represents a unit in which a plurality of chiller modules are coupled to each other. For example, the specific refrigeration ability may be about 2,000 RT, and the module assembly may include four chiller modules each having about 500 RT.

Hereinafter, power consumption when the single chiller and the module assembly having refrigeration ability of about 2,000 RT operate will be described.

In the case of the single chiller according to the related art, a current of maximum $I_{m1}$ may be applied to a compressor of the chiller device to exert large-capacity refrigeration ability. For example, the $I_{m1}$ may be about 520 A. Then, when a predetermined time elapses, a rated current for operating the single chiller may become to $I_{c1}$. For example, the $I_{c1}$ may be about 140 A.

On the other hand, with respect to the module assembly according to the current embodiment, in the case where the chiller modules are successively started, a current is applied to a first-rank chiller module at a time $t_1$. Here, a current of maximum $I_5$ may be applied. Then, when a predetermined time elapses, a rated current of $I_1$ may be applied. For example, the $I_5$ may be about 220 A, and the I1 may be about 40 A.

While the first-rank chiller module is operating, a current is applied to a second-rank chiller module at a time $t_2$. Here, a current of maximum $I_6$ may be applied. Then, when a predetermined time elapses, a rated current of $I_2$ may be applied. Here, the $I_2$ may be understood as a rated current required when two chiller modules operate. For example, the $I_6$ may be about 260 A, and the $I_2$ may be about 80 A.

While the first and second-rank chiller modules are operating, a current is applied to a third-rank chiller module at a time $t_3$. Here, a current of maximum $I_7$ may be applied. Then, when a predetermined time elapses, a rated current of $I_3$ may be applied. Here, the $I_3$ may be understood as a rated current required when three chiller modules operate. For example, the $I_7$ may be about 300 A, and the $I_3$ may be about 120 A.

While the first, second, and third-rank chiller modules are operating, a current is applied to a fourth-rank chiller module at a time $t_4$. Here, a current of maximum $I_{m2}$ may be applied. Then, when a predetermined time elapses, a rated current of $I_{c2}$ may be applied. Here, the $I_{c2}$ may be understood as a rated current required when four chiller modules operate. For example, the $I_{m2}$ may be about 340 A, and the $I_{c2}$ may be about 160 A.

When the chiller modules are successively started, a time intervals between starting times of the chiller modules, i.e., $t_2$-$t_1$, $t_3$-$t_2$, and $t_4$-$t_3$ may have the same as a preset value.

As described above, even when the chiller modules are successively started, the rated current may increase by a predetermined value. Thus, the maximum current value may increase by an increasing value of the rated current.

In summary, the final rated current $I_{c1}$ of the single chiller according to the related art and the final rated current $I_{c2}$ of the module assembly according to the current embodiment may be nearly similar to each other. That is, the powers consumed after the chiller system is started may be similar.

However, in the case of the single chiller according to the related art, the maximum starting current $I_{m1}$ may be about 520 A. However, in the case of the module assembly according to the current embodiment, the maximum starting current $I_{m2}$ may be about 340 A. That is, since the power consumption when the module assembly according to the current embodiment is started is less than that when the single chiller according to the related art is started, the power consumption may be reduced.

Hereinafter, various embodiments with respect to a configuration of the module assembly, particularly, an arrangement of the chiller module will be described with reference to the accompanying drawings.

Figure 14:
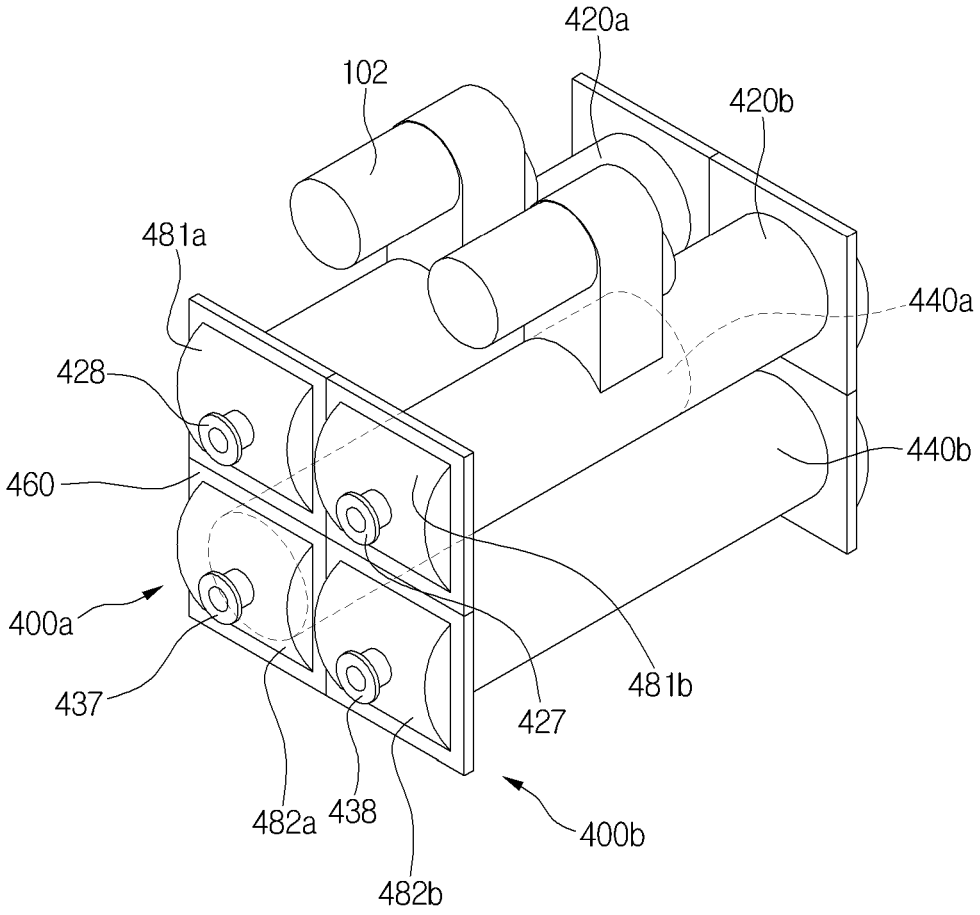
FIGS. 14 and 15 are views of a module assembly according to an exemplary embodiment.
Figure 15:
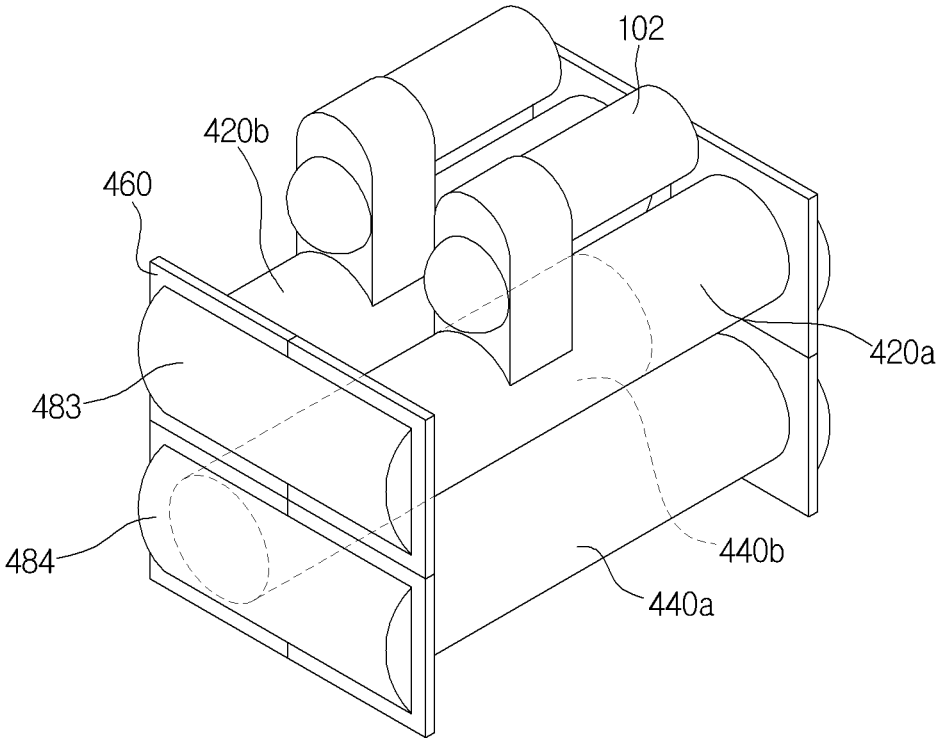

FIGS. 14 and 15 are views of a module assembly according to an embodiment.

Referring to FIGS. 14 and 15, in a module assembly according to an embodiment, a plurality of chiller modules 400*a* and 400*b* are parallely disposed and coupled to each other in a transverse or left/right direction. The plurality of chiller modules 400*a* and 400*b* include a first chiller module 400*a* and a second chiller module 400*b*.

The first chiller module 400*a* includes a first condenser 420*a* and a first evaporator 440*a* disposed under the first condenser 420*a*. Also, the second chiller module 400*b* includes a second condenser 420*b* and a second evaporator 440*b* disposed under the second condenser 420*b*.

Here, the first condenser 420*a* and the second condenser 420*b* are disposed in the left/right direction, and the first evaporator 440*a* and the second evaporator 440*b* are disposed in the left/right direction.

A support 460 is disposed on each of both sides of the first and second condensers 420*a* and 420*b* and each of both sides of the first and second evaporators 440*a* and 440*b*. A plurality of caps is provided on the support 460.

The plurality of caps include a first condenser cap 481*a* disposed on a side of the first condenser 420*a* and a second condenser cap 481*b* disposed on a side of the second condenser 420*b*. Also, a coolant outlet 428 is disposed in the first condenser cap 481*a*, and a coolant inlet 427 is disposed in the second condenser cap 481*b*.

A third condenser cap 483 is disposed on a support 460 disposed opposite to the first condenser cap 481*a* and the second condenser cap 481*b*. The third condenser cap 483 defines a coolant flow space for guiding a coolant flowing through the second condenser 420*b* into the first condenser 420*a*.

The plurality of caps include a first evaporator cap 482*a* disposed on a side of the first evaporator 440*a* and a second evaporator cap 482*b* disposed on a side of the second evaporator 440*b*. Also, a cold water inlet 437 is disposed in the first evaporator cap 482*a*, and a cold water outlet 438 is disposed in the second evaporator cap 482*b*.

A third evaporator cap 484 is disposed on a support 460 disposed opposite to the first evaporator cap 482*a* and the second evaporator cap 482*b*. The third evaporator cap 484 defines a cold water flow space for guiding cold water flowing through the first evaporator 440*a* into the second evaporator 440*b*.

As described above, the coolant outlet 428 and the cold water inlet 437 are disposed in the first chiller module 400*a*, and the coolant inlet 427 and the cold water outlet 438 are disposed in the second chiller module 400*b*. Thus, in the module assembly, a flow direction of the coolant and a flow direction of the cold water are opposite to each other.

Hereinafter, flows of the coolant and cold water in the module assembly according to the current embodiment will be described in detail with reference to the accompanying drawings.

Figure 16:
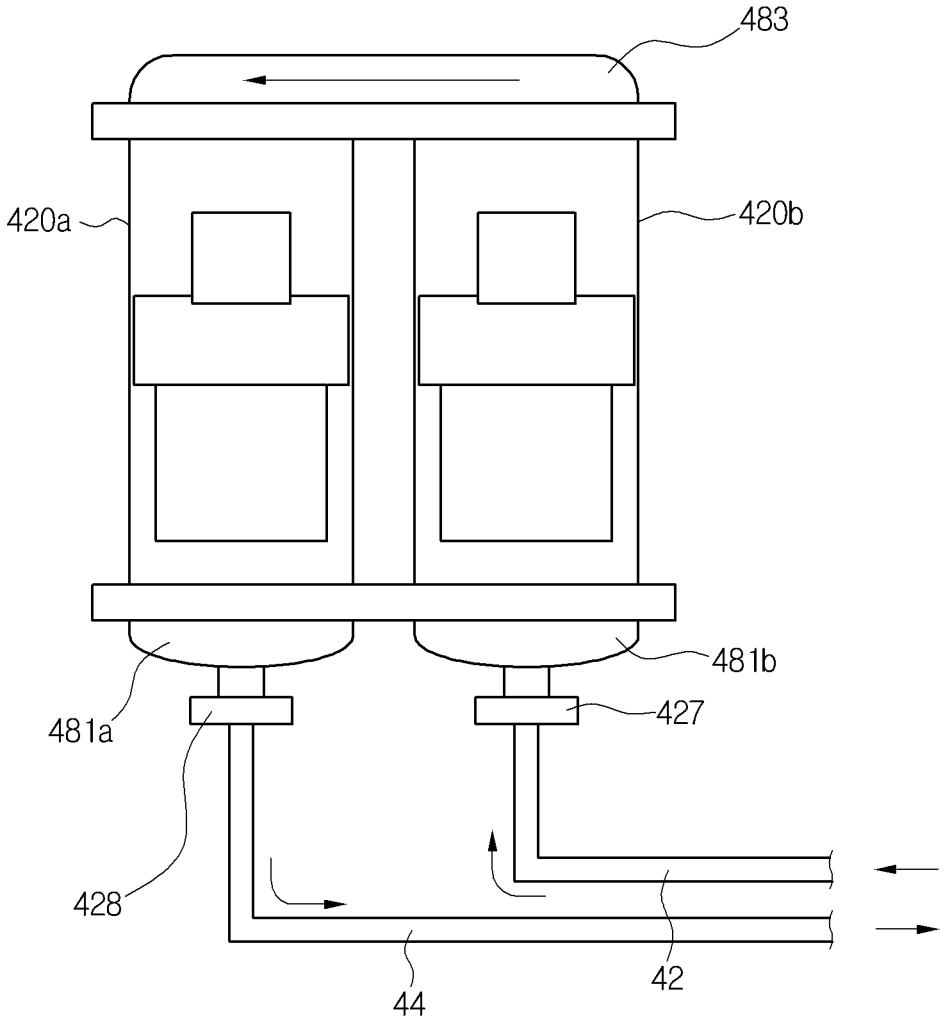
FIG. 16 is a view illustrating a flow of coolant within a condenser in the module assembly according to an exemplary embodiment.
Figure 17:
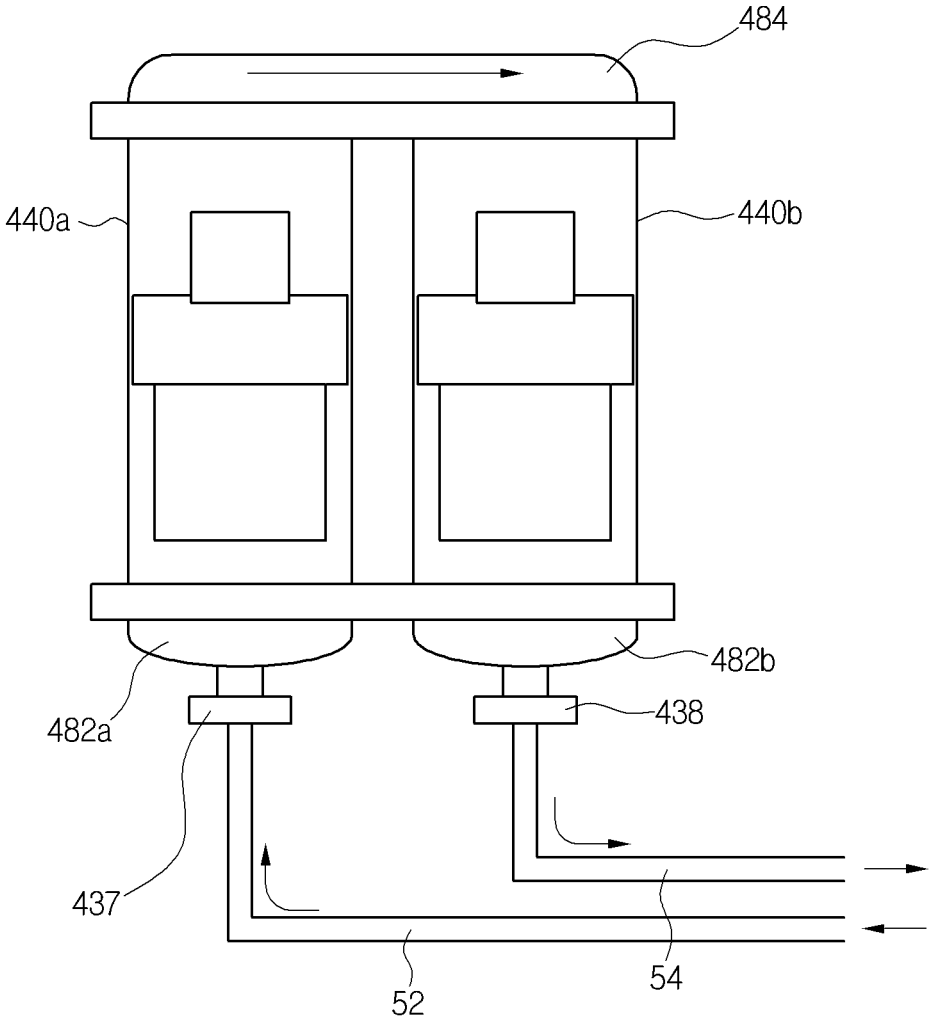
FIG. 17 is a view illustrating a flow of cold water within an evaporator in the module assembly according to an exemplary embodiment.
Figure 18:
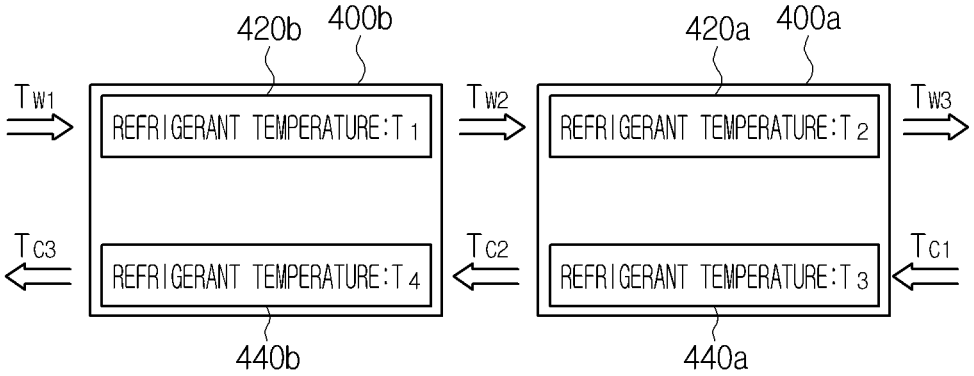
FIG. 18 is a view illustrating temperature changes of a heat-exchanged refrigerant, cold water, and coolant in the module assembly according to an exemplary embodiment.

FIG. 16 is a view illustrating a flow of coolant within a condenser in the module assembly according to an embodiment, FIG. 17 is a view illustrating a flow of cold water within an evaporator in the module assembly according to an embodiment, and FIG. 18 is a view illustrating temperature changes of a heat-exchanged refrigerant, cold water, and coolant in the module assembly according to an embodiment.

Referring to FIG. 16, in the module assembly according to the current embodiment, the coolant may be introduced into one condenser and discharged through the other condenser.

In detail, the coolant is introduced from a coolant inflow passage 42 into the second condenser 420*b* through the coolant inlet 427. Also, the coolant flows into the first condenser 420*a* via the third condenser cap 483. That is, the third condenser cap 483 may switch a flow direction of the coolant flowing in the second condenser 420*b* toward the first condenser 420*a*.

Also, the coolant is discharged from the first condenser 420*a* through the coolant outlet 428 to flow into the coolant discharge passage 44.

Referring to FIG. 17, in the module assembly according to the current embodiment, the cold water may be introduced into one evaporator and discharged through the other evaporator.

In detail, the cold water is introduced from a cold water inflow passage 52 into the first evaporator 440*a* through the cold water inlet 437. Also, the cold water flows into the second evaporator 440*b* via the third evaporator cap 484. The third evaporator cap 484 may switch a flow direction of the cold water flowing in the first evaporator 440*a* toward the second evaporator 440*b*.

Also, the cold water is discharged from the second evaporator 440*b* through the cold water outlet 438 to flow into the cold water discharge passage 54.

FIG. 18 illustrates flows of the coolant and cold water in the first and second chiller modules 400*a* and 400*b* according to the current embodiment. The first chiller module 400*a* and the second chiller module 400*b* perform independent refrigeration cycles, respectively. Also, a circulation direction of the coolant circulating into the condenser and a circulation direction of the cold water circulating into the evaporator are opposite to each other. This may be called a "counter-flow".

In detail, the coolant is introduced into the second condenser 420*b* at a temperature $T_{w1}$ and then primarily heat-exchanged. Then, the coolant is introduced into the first condenser 420*a* and then secondarily heat-exchanged. Here, the coolant has a temperature $T_{w2}$ after being heat-exchanged in the second condenser 420*b* and a temperature $T_{w3}$ after being heat-exchanged in the first condenser 420*a*.

For example, the temperature $T_{w1}$ may be about 32° C., the temperature $T_{w2}$ may be about 34.5° C., and the temperature $T_{w3}$ may be about 37° C. That is, the coolant may be introduced at a temperature of about 32° C. and discharged at a temperature of about 37° C. to cause a temperature difference $\Delta T_w$ of about 5° C.

Also, in the process, the coolant passing through the second condenser 420*b* may have a temperature $T_1$, and the coolant passing through the first condenser 420*a* may have a temperature $T_2$. For example, the temperature T1 may be about 35.5° C., and the temperature $T_2$ may be about 38° C.

In detail, the cold water is introduced into the first evaporator 440*a* at a temperature $T_{c1}$ and then primarily heat-exchanged. Then, the cold water is introduced into the second evaporator 440*b* and then secondarily heat-exchanged. Here, the cold water has a temperature $T_{c2}$ after being heat-exchanged in the first evaporator 440*a* and a temperature $T_{c3}$ after being heat-exchanged in the second evaporator 440*b*.

For example, the temperature $T_{c1}$ may be about 12° C., the temperature $T_{c2}$ may be about 9.5° C., and the temperature $T_{c3}$ may be about 7° C. That is, the cold water may be introduced at a temperature of about 12° C. and discharged at a temperature of about 7° C. to cause a temperature difference $\Delta T_c$ of about 5° C.

Also, in the process, the cold water passing through the first evaporator 440*a* may have a temperature $T_3$, and the cold water passing through the second evaporator 440*b* may have a temperature $T_4$. For example, the temperature T3 may be about 8° C., and the temperature $T_4$ may be about 5.5° C.

As a result, in the chiller module, a difference ΔT' between the condensing temperature (38° C.) and the evaporating temperature (8° C.) in the first chiller module 400*a* may be about 30° C., and a difference $\Delta T_2$ between the condensing temperature (35.5° C.) and the evaporating temperature (5.5° C.) in the second chiller module 400*b* may be about 30° C. Thus, in the refrigeration cycle of each of the chiller modules 400*a* and 400*b*, a difference between a high pressure and a low pressure may be defined as a pressure corresponding to the temperature difference (30° C.).

On the other hand, in a case of the single chiller unit (the related art) having the same refrigeration ability as that of the module assembly according to the current embodiment, to obtain a desired cold water discharge temperature, the coolant and cold water temperatures of the condenser and evaporator through which the coolant and cold water are respectively discharged define the condensing and evaporating temperatures, respectively.

That is, since the condensing temperature is about 38° C., and the evaporating temperature is about 5.5° C., a difference value between the condensing temperature and the evaporating temperature may be about 32.5° C. Thus, in the refrigeration cycle of the single chiller, a difference between a high pressure and a low pressure may be defined as a pressure corresponding to the temperature difference (32.5° C.)

In summary, when compared to the single chiller unit according to the related art, in the case of the module assembly according to the current embodiment, since the difference between the high pressure and the low pressure in the refrigeration cycle is less, system efficiency in the current embodiment may be improved.

Figure 19:
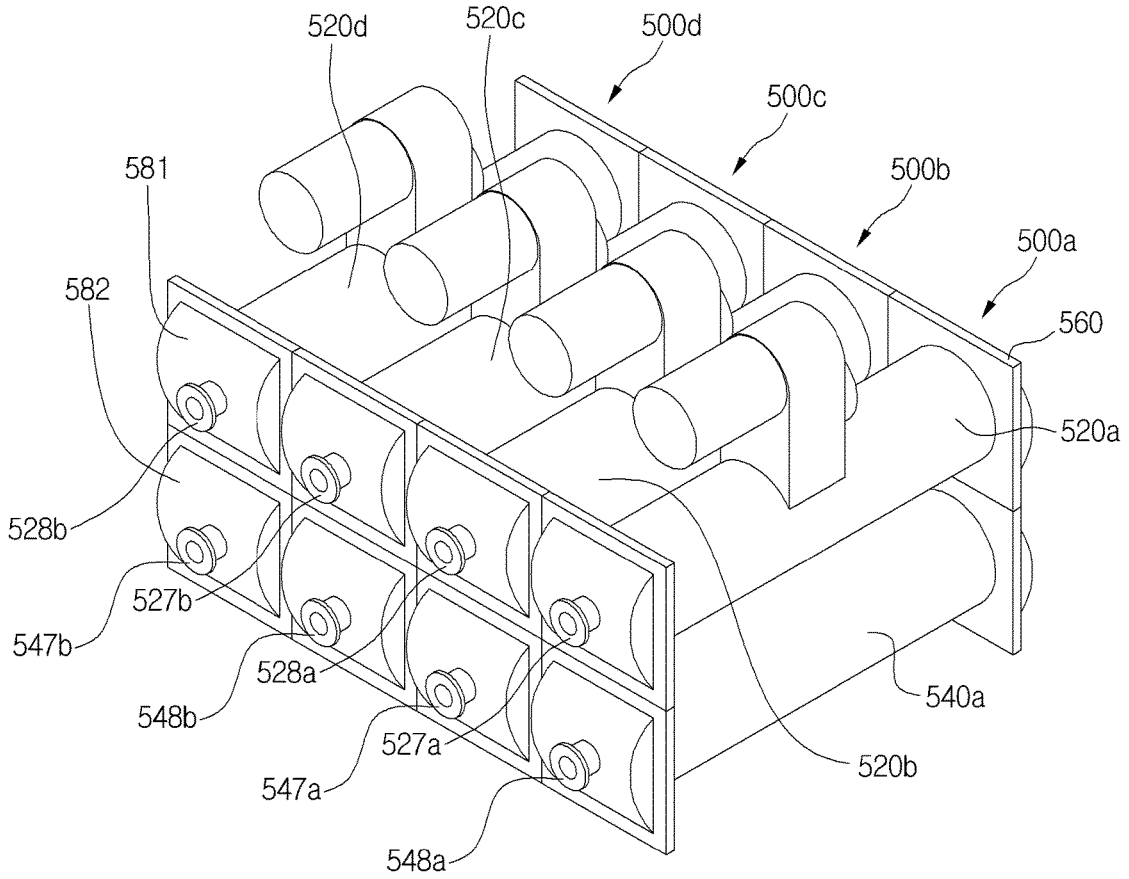
FIGS. 19 and 20 are view of a module assembly according to another exemplary embodiment.
Figure 20:
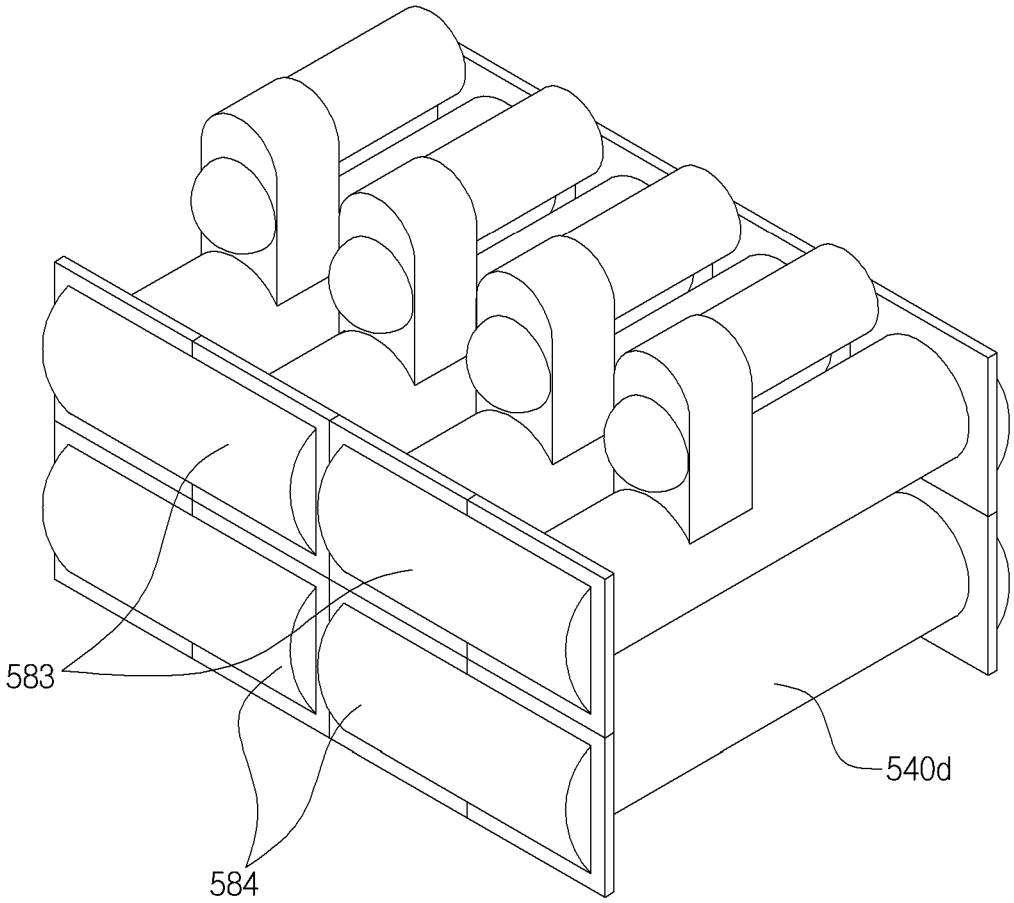
Figure 21:
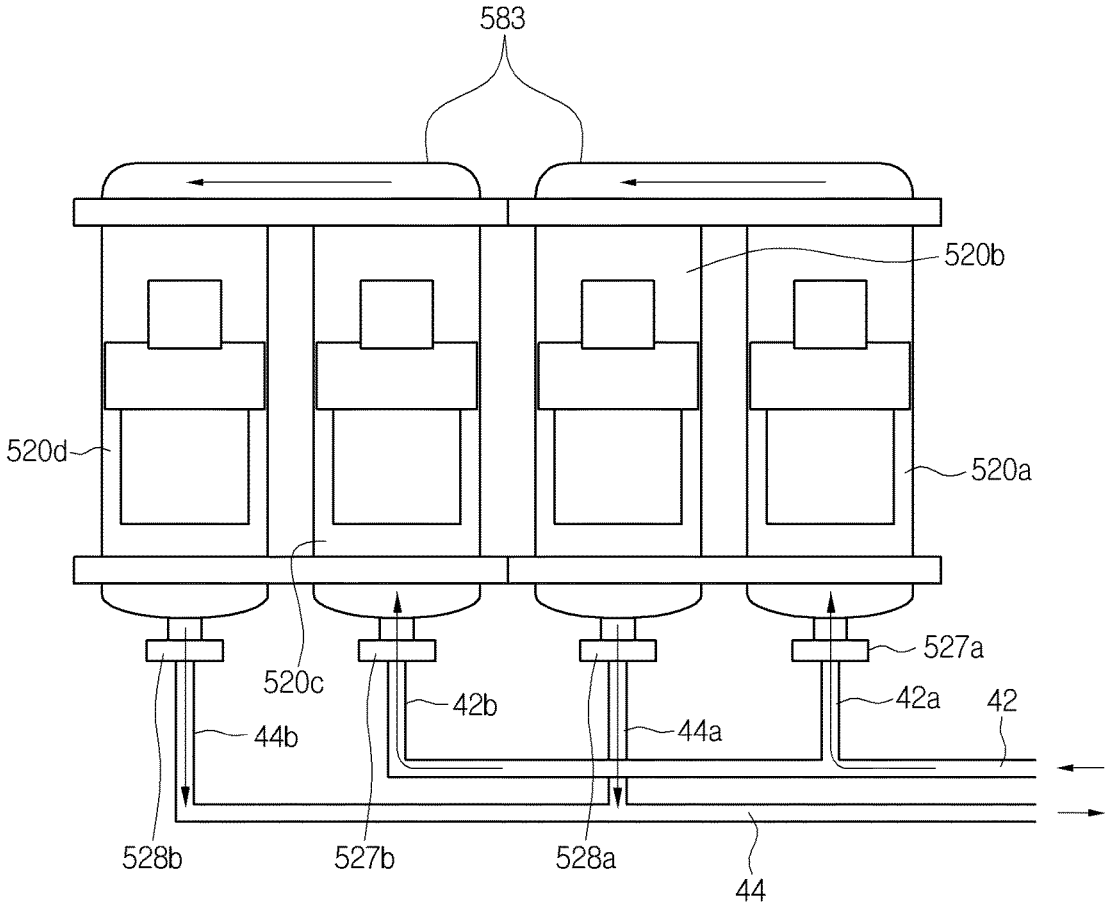
FIG. 21 is a view illustrating a flow of coolant within a condenser in the module assembly according to another exemplary embodiment.
Figure 22:
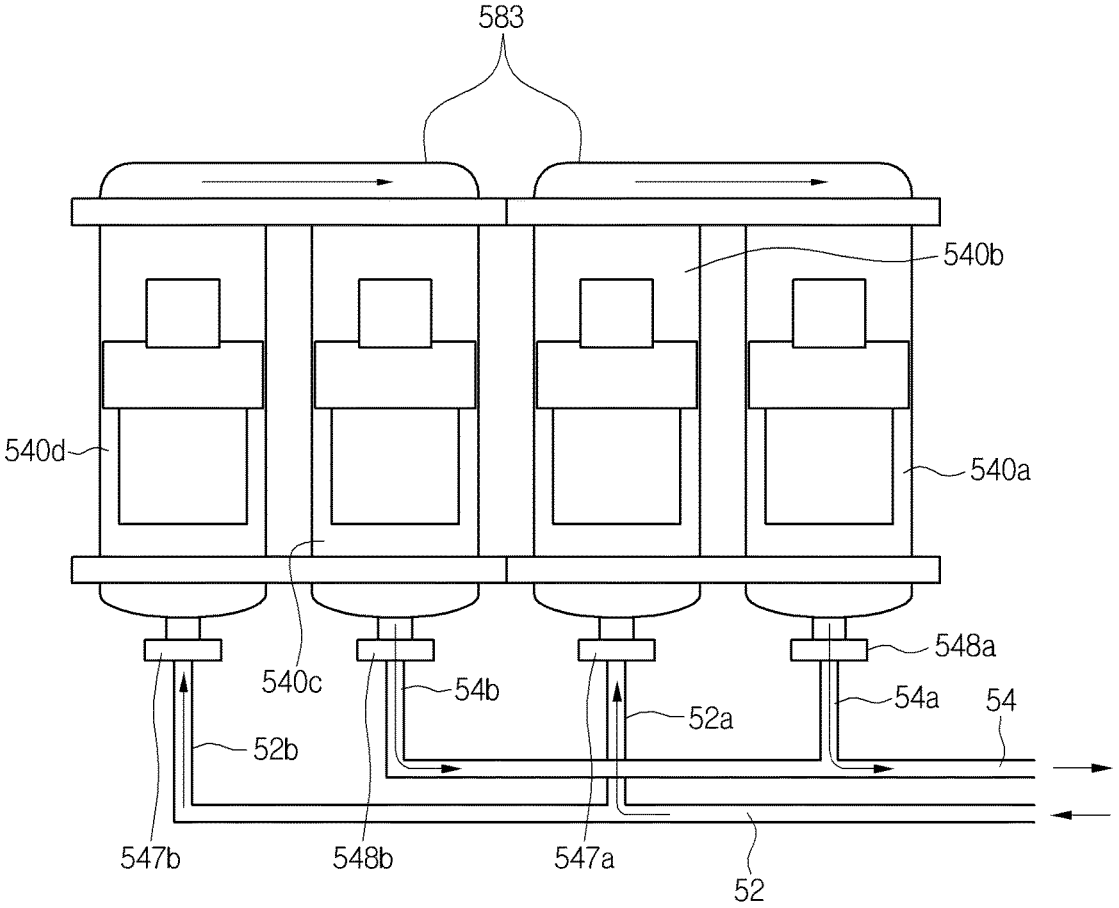
FIG. 22 is a view illustrating a flow of cold water within an evaporator in the module assembly according to another exemplary embodiment.

FIGS. 19 and 20 are view of a module assembly according to another embodiment, FIG. 21 is a view illustrating a flow of coolant within a condenser in the module assembly according to another embodiment, and FIG. 22 is a view illustrating a flow of cold water within an evaporator in the module assembly according to another embodiment.

Referring to FIGS. 19 and 20, a module assembly according to the current embodiment includes a plurality of chiller modules which are parallely disposed in a transverse direction. For example, the plurality of chiller modules includes four (even number) chiller modules. In detail, the plurality of chiller modules include a first chiller module 500*a*, a second chiller module 500*b*, a third chiller module 500*c*, and a fourth chiller module 500*d*.

Each of the chiller modules has the same constitution as that of the foregoing embodiment. A different point with respect to the foregoing embodiment is that the number of chiller modules is changed from two into four.

The first chiller module 500*a* includes a first condenser 520*a* and a first evaporator 540*a*, the second chiller module 500*b* includes a second condenser 520*b* and a second evaporator 540*b*, the third chiller module 500*c* includes a third condenser 520*c* and a third evaporator 540*c*, and the fourth chiller module 500*d* includes a fourth condenser 520*d* and a fourth evaporator 540*d*. The first, second, third, and fourth chiller modules may be parallely arranged in order.

A support 560 is disposed on each of both sides of each of the chiller modules. Also, one condenser cap 581 and one evaporator cap 582 may be disposed on one side support 560, and the other condenser cap 583 and the other evaporator cap 584 may be disposed on the other side support 560.

A first coolant inlet 527*a* through which a coolant is introduced is disposed in the first chiller module 500*a*, and a second coolant inlet 527*b* through which the coolant is introduced is disposed in the third chiller module 500*c*. The coolant is branched and introduced into the first coolant inlet 527*a* and the second coolant inlet 527*b*.

Also, a first coolant outlet 528*a* through which the coolant is discharged is disposed in the second chiller module 500*b*, and a second coolant outlet 528*b* through which the coolant is discharged is disposed in the fourth chiller module 500*d*. The coolant is branched and introduced into the first coolant outlet 528*a* and the second coolant outlet 528*b*.

Referring to FIG. 21, the coolant flowing into the coolant inflow passage 42 is branched and introduced into the first coolant inlet 527*a* and the second coolant inlet 527*b*. For this, the coolant inflow passage 42 includes a first branch part 42*a* connected to the first coolant inlet 527*a* and a second branch part 42*b* connected to the second coolant inlet 527*b*.

The coolant introduced into the first condenser 520*a* flows into the second condenser 520*b* through the condenser cap 583 and flows into the coolant discharge passage 44 through the first coolant outlet 528*a*.

Also, the coolant introduced into the third condenser 520*c* flows into the fourth condenser 520*d* through the condenser cap 583 and flows into the coolant discharge passage 44 through the second coolant outlet 528*b*.

That is, the coolant discharged from the condenser may be mixed to flow into the coolant discharge passage 44. For this, the coolant discharge passage 44 includes a first combing part 44*a* connected to the first coolant discharge part 528*a* and a second combing part 44*b* connected to the second coolant discharge part 528*b*.

Also, a cold water inlet 547*a* through which the cold water is introduced is disposed in the second chiller module 500*b*, and a second cold water inlet 528*b* through which the cold water is introduced is disposed in the fourth chiller module 500*d*. The cold water is branched and introduced into the first cold water inlet 547*a* and the second cold water inlet 547*b*.

Also, a first cold water outlet 548*a* through which the cold water is discharged is disposed in the first chiller module 500*a*, and a second cold water outlet 548*b* through which the cold water is discharged is disposed in the third chiller module 500*c*. The cold water is branched and discharged into the first cold water outlet 548*a* and the second cold water outlet 548*b*.

Referring to FIG. 22, the coolant flowing into the cold water inflow passage 52 is branched and introduced into the first cold water inlet 547*a* and the second cold water inlet 547*b*. For this, the cold water inflow passage 52 includes a third branch part 52*a* connected to the first cold water inlet 547*a* and a fourth branch part 52*b* connected to the second cold water inlet 547*b*.

The cold water introduced into the second evaporator 540*b* flows into the first evaporator 540*b* through the evaporator cap 584 and flows into the cold water discharge passage 54 through the first cold water outlet 548*a*.

Also, the cold water introduced into the fourth condenser 520*d* flows into the third condenser 540*c* through the evaporator cap 584 and flows into the cold water discharge passage 54 through the second cold water outlet 548*b*.

That is, the cold water discharged from the evaporator is mixed to flow into the cold water discharge passage 54. For this, the cold water discharge passage 54 includes a third combing part 54*a* connected to the first cold water discharge part 548*a* and a fourth combing part 54*b* connected to the second cold water discharge part 548*b*.

As described above, while the coolant may be branched to pass through the plurality of condensers, the heat exchange may be effectively performed, and also, while the cold water may be branched to pass through the plurality of evaporators, the heat exchange may be effectively performed.

Figure 23:
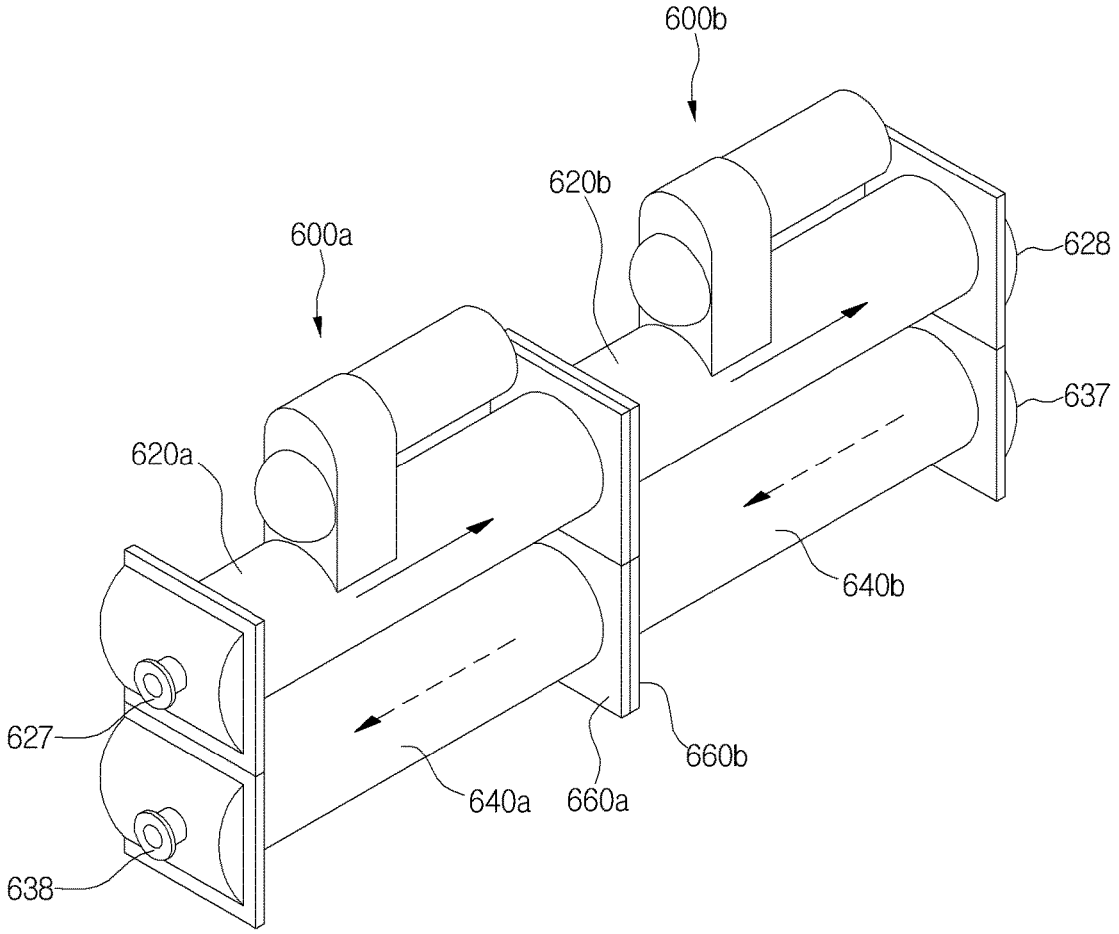
FIG. 23 is a view of a module assembly according to further another exemplary embodiment.

FIG. 23 is a view of a module assembly according to further another embodiment.

Referring to FIG. 23, a module assembly according to the current embodiment includes a plurality of chiller modules 600*a* and 600*b*. The plurality of chiller modules 600*a* and 600*b* include a first chiller module 600*a* and a second chiller module 600*b* which are parallely arranged and coupled to each other in a longitudinal direction or a front/rear direction.

The first chiller module 600*a* includes a first condenser 620*a* and a first evaporator 640*a* disposed under the first condenser 620*a*. Also, the second chiller module 600*b* includes a second condenser 620*b* and a second evaporator 640*b* disposed under the second condenser 620*b*.

A first support 660*a* disposed on an end of the first chiller module 600*a* and a second support 660*b* disposed on an end of the second chiller module 600*b* may be coupled to each other.

The first condenser 620*a* and the second condenser 620*b* may be disposed in the approximate same extension line. That is, an end of a side of the first condenser 620*a* may be coupled to an end of a side of the second condenser 620*b*.

The first evaporator 640*a* and the second evaporator 640*b* may be disposed in the approximate same extension line. That is, an end of a side of the first evaporator 640*a* may be coupled to an end of a side of the second evaporator 640*b*.

A coolant inlet 627 through which a coolant is introduced and a cold water outlet 638 through which cold water is discharged are disposed in the first chiller module 600*a*. The coolant inlet 627 may be disposed in a cap disposed on an end of the first condenser 620*a*, and the cold water outlet 638 may be disposed in a cap disposed on an end of the first evaporator 640*a*.

A coolant outlet 628 through which a coolant is discharged and a cold water inlet 637 through which cold water is introduced are disposed in the second chiller module 600*b*. The coolant outlet 628 may be disposed in a cap disposed on an end of the second condenser 620*b*, and the cold water inlet 637 may be disposed in a cap disposed on an end of the second evaporator 640*b*.

A flow of the coolant and cold water according to the current embodiment will be simply described.

The coolant introduced into the first condenser 620*a* through the coolant inlet 627 is heat-exchanged in the first condenser 620*a* and then introduced into the second condenser 620*b*. Also, the coolant passing through the second condenser 620*b* is discharged from the second chiller module 600*b* through the coolant outlet 628.

Here, the coolant flows in one direction without being switched in flow direction until the coolant is introduced from the coolant inlet 627 and discharged from the coolant outlet 628 (a solid line arrow).

The cold water introduced into the second evaporator 640*b* through the cold water inlet 637 is heat-exchanged in the second evaporator 640*b* and then introduced into the first evaporator 640*a*. Also, the cold water passing through the second evaporator 640*a* is discharged from the first chiller module 600*a* through the cold water outlet 638 (a dot line arrow).

Here, the cold water flows in the other direction without being switched in flow direction until the cold water is introduced from the cold water inlet 637 and discharged from the cold water outlet 638. Also, the one direction in which the coolant flows and the other direction in which the cold water flows are opposite to each other.

Figure 24:
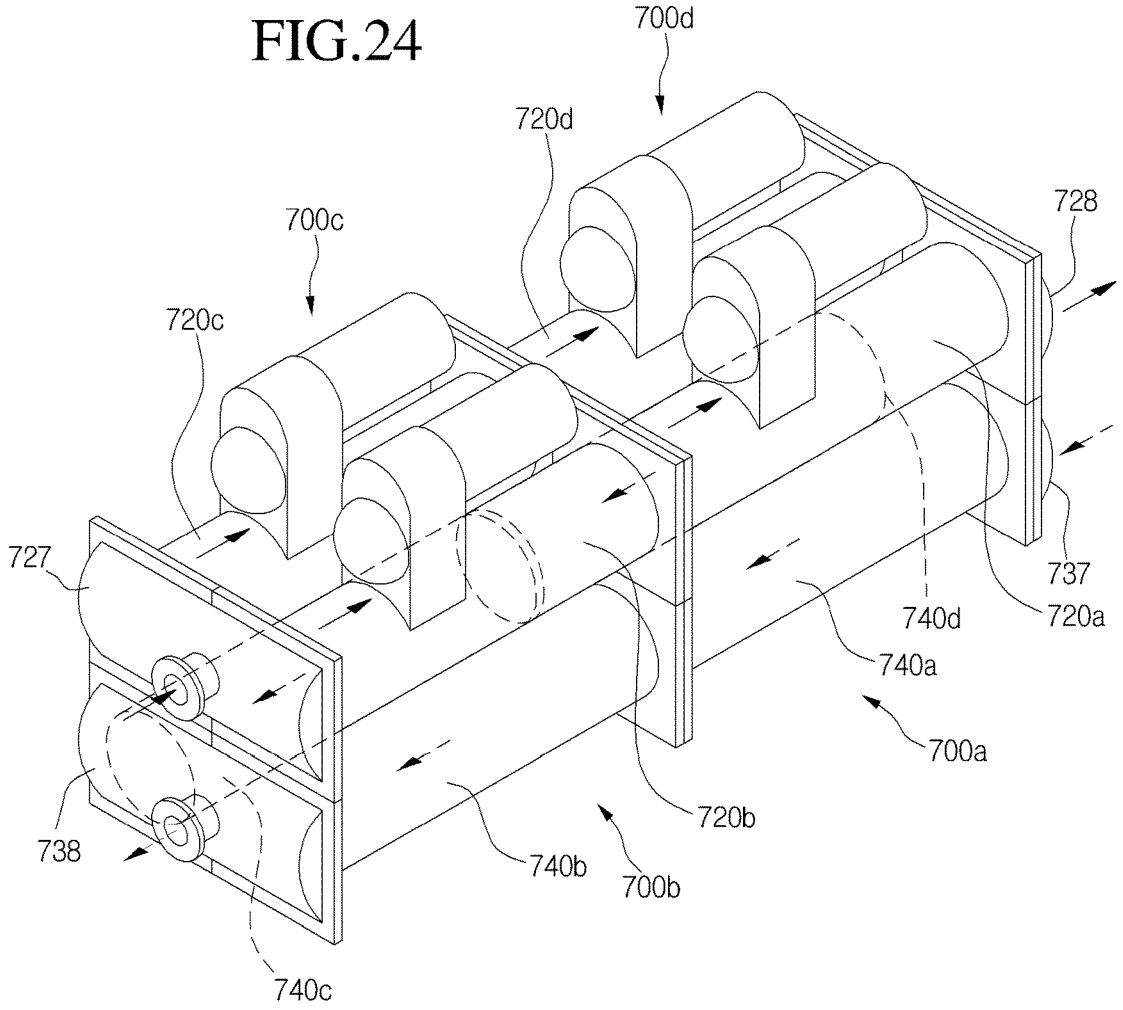
FIG. 24 is a view of a module assembly according to further another embodiment.

FIG. 24 is a view of a module assembly according to further another embodiment.

Referring to FIG. 24, a module assembly according to an embodiment includes a plurality of chiller modules 700*a*, 700*b*, 700*c*, and 700*d*. The plurality of chiller modules 700*a*, 700*b*, 700*c*, and 700*d* include a first chiller module 700*a*, a second chiller module 700*b* parallely disposed in a longitudinal or front/rear direction with respect to the first chiller module 700*a*, a third chiller module 700*c* parallely disposed in a transverse or left/right direction with respect to the second chiller module 700*b*, and a fourth chiller module 700*d* parallely disposed in a longitudinal direction with respect to the third chiller module 700*c*.

The module assembly according to the current embodiment may be understood as the two module assemblies of FIG. 23 are parallely disposed in a transverse direction.

The first chiller module 700*a* includes a first condenser 720*a* and a first evaporator 740*a* disposed under the first condenser 720*a*. The second chiller module 700*b* includes a second condenser 720*b* and a second evaporator 740*b* disposed under the second condenser 720*b*.

Also, the third chiller module 700*c* includes a third condenser 720*c* and a third evaporator 740*c* disposed under the third condenser 720*c*. The fourth chiller module 700*d* includes a fourth condenser 720*d* and a fourth evaporator 740*d* disposed under the fourth condenser 720*d*.

A coolant inlet 727 through which a coolant is introduced and a cold water outlet 738 through which cold water is discharged are disposed in one side of the second chiller module 700*b* and the third chiller module 700*c*. The coolant inlet 727 may be disposed in a cap disposed on an end of each of the second condenser 720*b* and the third condenser 720*c*, and the cold water outlet 738 may be disposed in a cap disposed on an end of each of the second evaporator 740*b* and the third evaporator 740*c*.

A coolant outlet 728 through which a coolant is discharged and a cold water inlet 737 through which cold water is introduced are disposed in the first chiller module 700*a* and the fourth chiller module 700*d*. The coolant outlet 728 may be disposed in a cap disposed on an end of each of the first condenser 720*a* and the fourth condenser 720*d*, and the cold water inlet 737 may be disposed in a cap disposed on an end of each of the first evaporator 740*a* and the fourth evaporator 740*d*.

A flow of the coolant and cold water according to the current embodiment will be simply described.

The coolant flowing into the coolant inlet 727 is branched and introduced into the second condenser 720*b* and the third condenser 720*c*. Also, the introduced coolant is heat-exchanged in the second condenser 720*b* and the third condenser 720*c* and then introduced into the first condenser 720*a* and the fourth condenser 720*d*, respectively.

Also, the coolant passing through the first condenser 720*a* and the fourth condenser 720*d* is mixed in the cap, and the mixed coolant is discharged through the coolant outlet 728.

Here, the coolant flows in one direction without being switched in flow direction until the coolant is introduced from the coolant inlet 727 and discharged from the coolant outlet 728 (a solid line arrow).

The cold water flowing into the cold water inlet 737 is branched and introduced into the first evaporator 740*a* and the fourth evaporator 740*d*. Also, the introduced cold water is heat-exchanged in the first evaporator 740*a* and the fourth evaporator 740*d* and then introduced into the second evaporator 740*b* and the third evaporator 740*c*, respectively.

Also, the cold water passing through the second evaporator 740*b* and the third evaporator 740*c* is mixed in the cap, and the mixed cold water is discharged through the cold water outlet 738 (a dot line arrow).

Here, the cold water flows in the other direction without being switched in flow direction until the cold water is introduced from the cold water inlet 737 and discharged from the cold water outlet 738. Also, the one direction in which the coolant flows and the other direction in which the cold water flows are opposite to each other.

Hereinafter, a refrigeration cycle of a chiller module according to a third exemplary embodiment will be described. A refrigeration cycle according to the current embodiment is different from that of FIG. 7 with respect to some of the components. Thus, their different points may be mainly described, and also, the same components will be denoted by the same description and reference numeral of FIG. 7.

Figure 25:
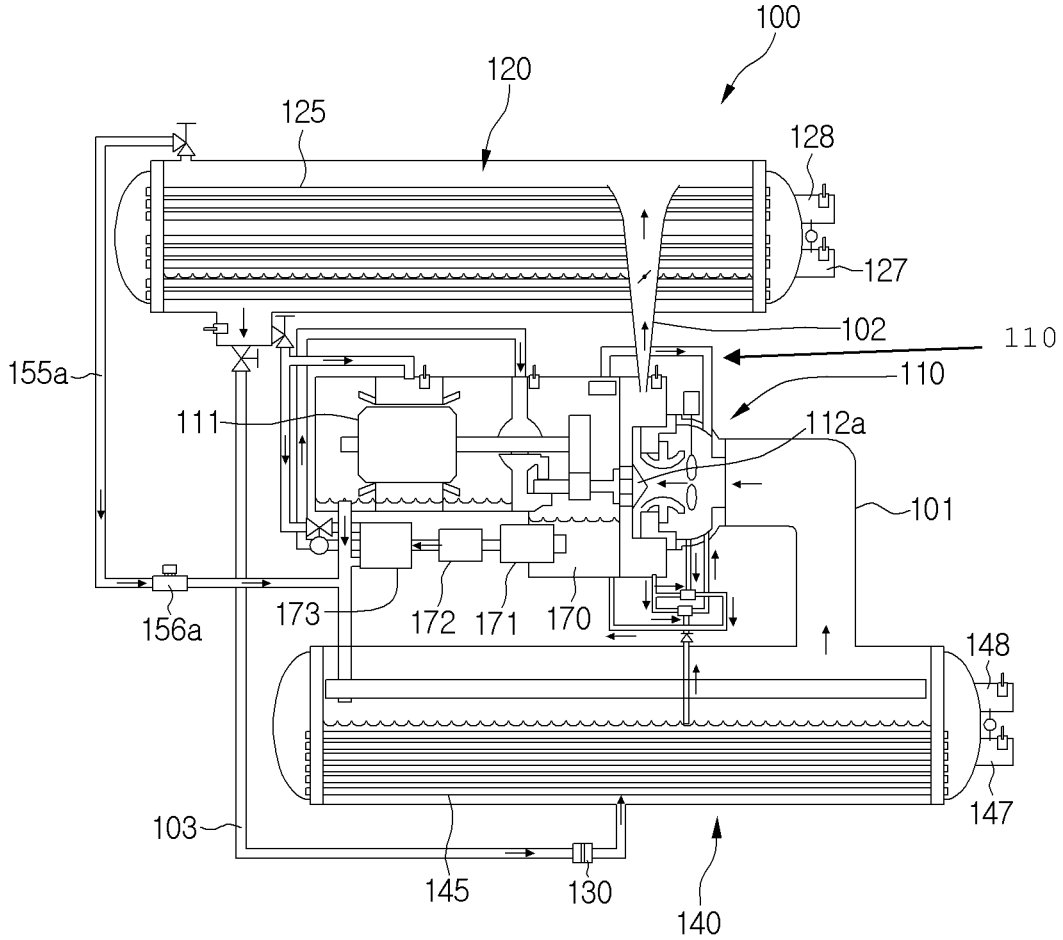
FIG. 25 is a system view of a refrigeration cycle with respect to a chiller module according to a third exemplary embodiment.

FIG. 25 is a system view of a refrigeration cycle with respect to a chiller module according to a third embodiment.

Referring to FIG. 25, a chiller module 100 according to the third embodiment includes a compressor 110, a condenser 120, an expansion device 130, and an evaporator 140. The chiller module 100 according to the current embodiment may be understood as a one-stage compression type chiller device.

The refrigerant compressed in the compressor 110 is introduced into the condenser 120. A bypass tube 155*a* bypassing the refrigerant of the condenser 120 into the evaporator 140 is disposed on a side of the condenser 120. Also, a bypass valve 156*a* for adjusting a flow rate of the refrigerant is disposed in the bypass tube 155*a*.

The refrigerant condensed in the condenser 120 flows through a condenser outlet tube 103 and is expanded in the expansion device 130. The refrigerant expanded in the expansion device 130 is introduced into the evaporator 140. Also, the refrigerant evaporated in the evaporator 140 is introduced into the compressor 110 through the suction tube 101.

Oil within the evaporator 140 may be recovered into an oil sump 170 through an oil recovery tube 108.

In detail, the compressor 110 includes an oil sump 170 in which an oil is stored, an oil pump 171 operating to circulate the oil into the compressor 110 and the evaporator 140, a filter 172 filtering foreign substances from the oil passing through the oil pump 171, and an oil cooler 173 cooling the circulating oil.

In detail, the compressor 110 includes a motor 111 generating a driving force and one impeller 112*a* rotatable by using a rotation force of the motor 111.

The high-pressure refrigerant compressed while passing through the impeller 112*a* may be introduced into the condenser 120 through the discharge tube 102.

As described above, in the case of the one-stage compression type chiller module, the refrigerant may be compressed by using one impeller; heat exchange is performed in the condenser and evaporator by using the compressed refrigerant. The one-stage compression type chiller module may have a wide operation range and superior cooling efficiency.

Another embodiment will be proposed.

The above-described embodiments have a feature in which the condenser and the evaporator are shell tube-type heat exchangers. On the other hand, the condenser and evaporator may be plate-type heat exchangers.

When the condenser and evaporator are provided as the plate type heat exchangers, the flow space of the refrigerant and the flow space of the coolant or cold water may be successively stacked.

Hereinafter, a fourth embodiment will be described. This embodiment is the same as the first embodiment except for a constitution of a module assembly. Thus, the same part as the first embodiment will be denoted by the description and reference numeral of the first embodiment. Particularly, the controllable constitution and control method as described in FIGS. 8 to 12 may be applicable in the current embodiment.

Figure 26:
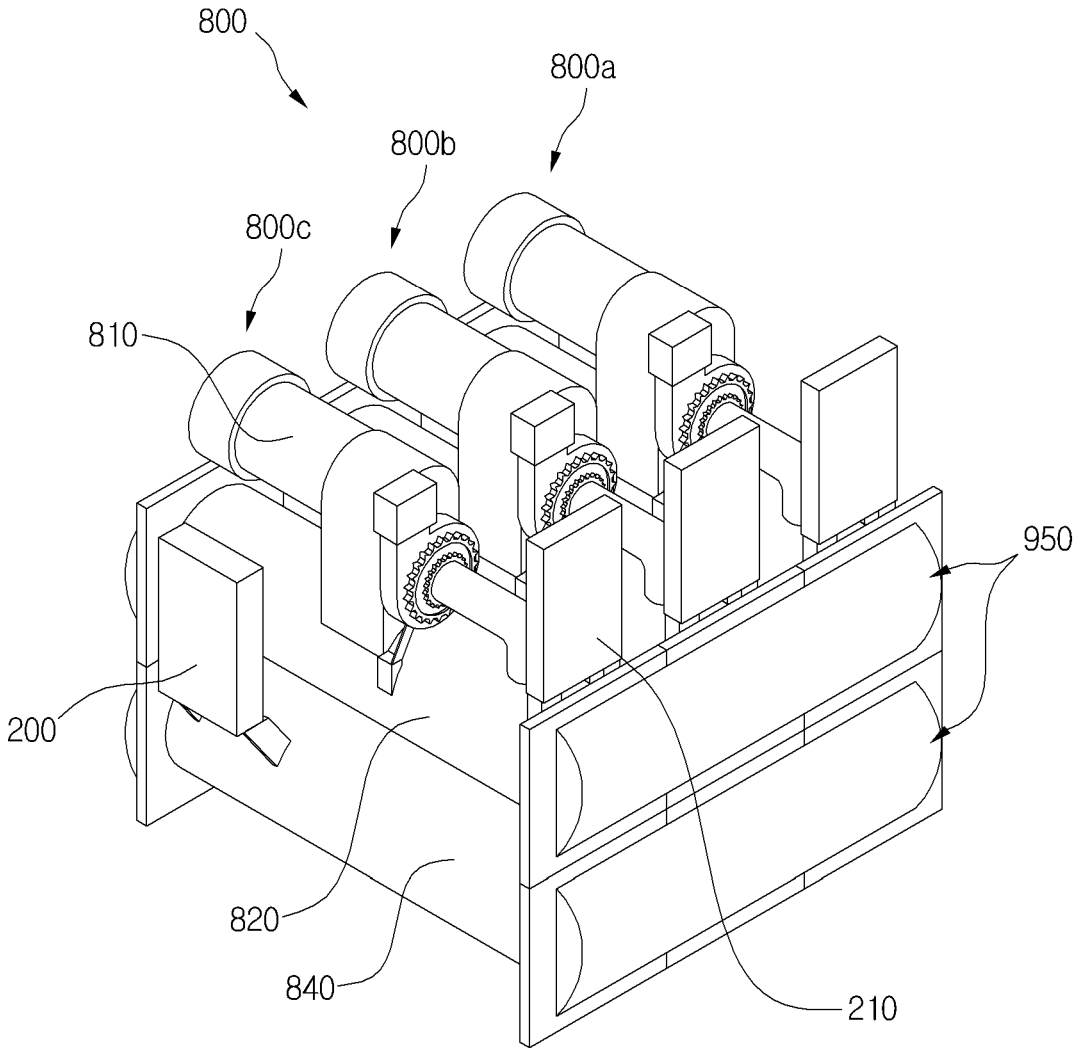
FIG. 26 is a front perspective view of a module assembly according to a fourth exemplary embodiment.
Figure 27:
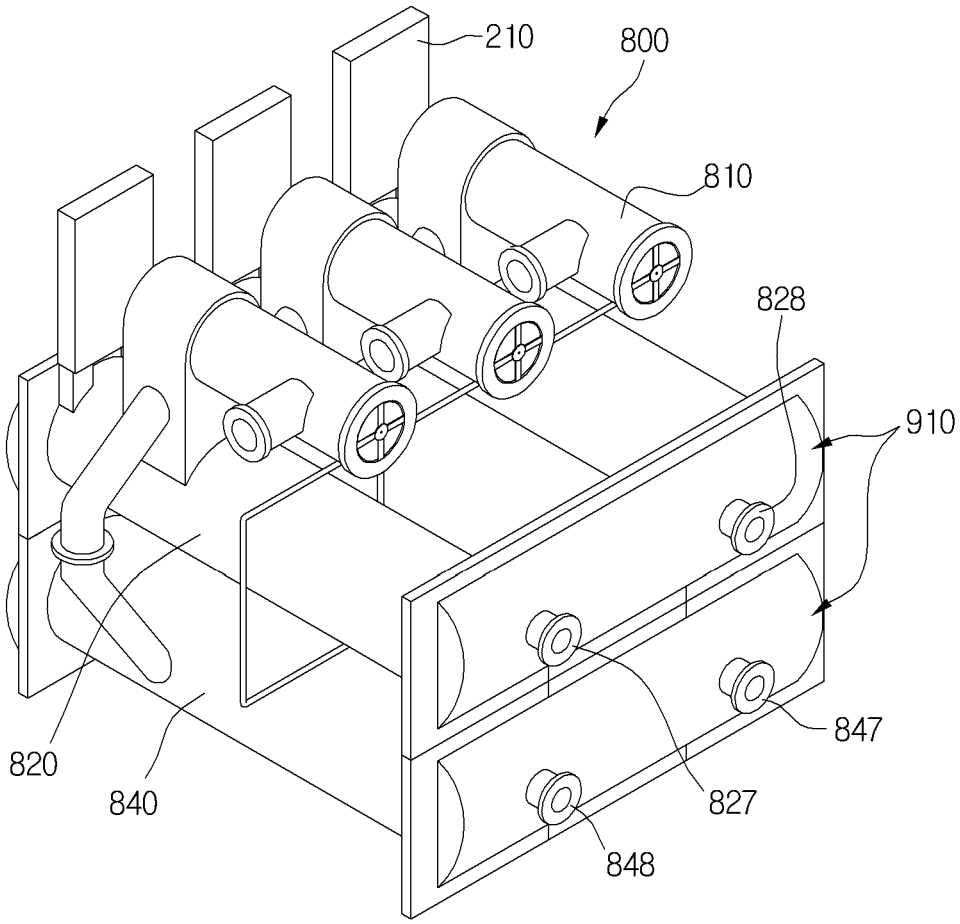
FIG. 27 is a rear perspective view of the module assembly according to the fourth exemplary embodiment.

FIG. 26 is a front perspective view of a module assembly according to a fourth embodiment, and FIG. 27 is a rear perspective view of the module assembly according to the fourth embodiment.

Referring to FIGS. 26 to 27, a module assembly according to the fourth embodiment includes a plurality of chiller modules 800. As shown in FIG. 2, each of the chiller modules 800 may perform an independent refrigeration cycle and have the same refrigeration ability.

On the basis of the refrigeration ability required for the chiller system, the module assembly may include odd number of chiller modules. That is, the module assembly may include three, fifth, or seventh chiller modules. For example, three chiller modules, i.e., a first chiller module 800*a*, a second chiller module 800*b*, and a third chiller module 800*c* are coupled to constitute the module assembly.

If it is assumed that one chiller module has refrigeration ability of about 500 RT, it may be understood that the chiller system according to the current embodiment has refrigeration ability of about 1,500 RT through three chiller modules.

Each of the chiller modules includes a compressor 810, a condenser 820, and an evaporator 840. The condenser 820 may be disposed above the evaporator 840, and the compressor 810 may be disposed above the condenser 820. However, for another example, the evaporator 840 may be disposed above the condenser 820.

The chiller module 800 includes a discharge tube 102 extending downward from the compressor 810 and connected to the condenser 820 and a suction tube 101 extending upward from the evaporator 840 and connected to the compressor 810. Also, an economizer 150 may be disposed on an approximate point between the condenser 820 and the evaporator 840.

The chiller module 800 includes a plurality of cap assemblies 910 and 950 disposed on both sides of the condenser 820 and the evaporator 840. The plurality of cap assemblies 910 and 950 provides a flow space of a coolant or cold water.

The plurality of cap assemblies 910 and 950 include a first cap assembly 910 disposed on one side of each of the condenser 820 and the evaporator 840 and a second cap assembly 950 disposed on the other side of each of the condenser 820 and the evaporator 840.

The first cap assemblies 910 may be respectively disposed on the condenser 820 and the evaporator 840 and coupled to each other. The first cap assembly 910 coupled to the condenser 820 may be called a "first condenser cap assembly", and the first cap assembly 910 coupled to the evaporator 840 may be called a "first evaporator cap assembly". The first condenser cap assembly and the first evaporator cap assembly may have the constitution.

Also, the second cap assemblies 950 may be respectively disposed on the condenser 820 and the evaporator 840 and coupled to each other. The second cap assembly 950 coupled to a side of the condenser 820 may be called a "second condenser cap assembly", and the second cap assembly 950 coupled to a side of the evaporator 840 may be called a "first evaporator cap assembly". The second condenser cap assembly and the second evaporator cap assembly may have the constitution.

A plurality of passages guiding a flow of coolant or cold water is disposed in a side of the chiller module 800. The plurality of passage include a coolant inflow passage 42, a coolant discharge passage 44, a cold water inflow passage 52, and a cold water discharge passage 54.

The coolant inflow part 827 connected to the coolant inflow passage 42 and a coolant discharge part 828 connected to the coolant discharge passage 44 are disposed on the first condenser cap assembly 910.

Also, the cold water inflow part 847 connected to the cold water inflow passage 52 and a cold water discharge part 848 connected to the cold water discharge passage 54 are disposed on the first evaporator cap assembly 910. The cold water inflow part 847 is disposed under the coolant discharge part 828, and the cold water discharge part 848 is disposed under the coolant inflow part 827.

Thus, a circulation direction of the coolant circulating into the condenser provided in the plurality of chiller modules 800 and a circulation direction of the cold water circulating into the evaporator provided in the plurality of chiller modules 800 are opposite to each other. This may be called a counter-flow, and related descriptions will be described later with reference to FIG. 32.

The coolant flowing into the coolant inflow passage 42 is introduced into the plurality of chiller modules 800 through the coolant inflow part 827. Also, the coolant is heat-exchanged in the condenser 820 provided in the plurality of chiller modules 800, and the heat-exchanged coolant may be discharged through the coolant discharge passage 44 (see FIG. 31).

The cold water flowing into the cold water inflow passage 52 is introduced into the plurality of chiller modules 800 through the cold water inflow part 847. Also, the cold water is heat-exchanged in the evaporator 840 provided in the plurality of chiller modules 800, and the heat-exchanged cold water may be discharged through the cold water discharge passage 54 (see FIG. 32).

The module assembly includes a control device controlling operations of the plurality of chiller modules 800.

The control device includes a main control device 200 controlling an operation of the chiller module according to a required refrigeration load or an operation load of the chiller module and a plurality of module control devices 210 respectively disposed on the chiller modules 800 to receive an operation signal from the main control device 200, thereby controlling an operation of each of the chiller module 800.

A plurality of module control devices 210 may be disposed above the second cap assembly 950. Also, the main control device 200 may be disposed on one chiller module of the plurality of chiller modules 800 constituting the module assembly.

Figure 28:
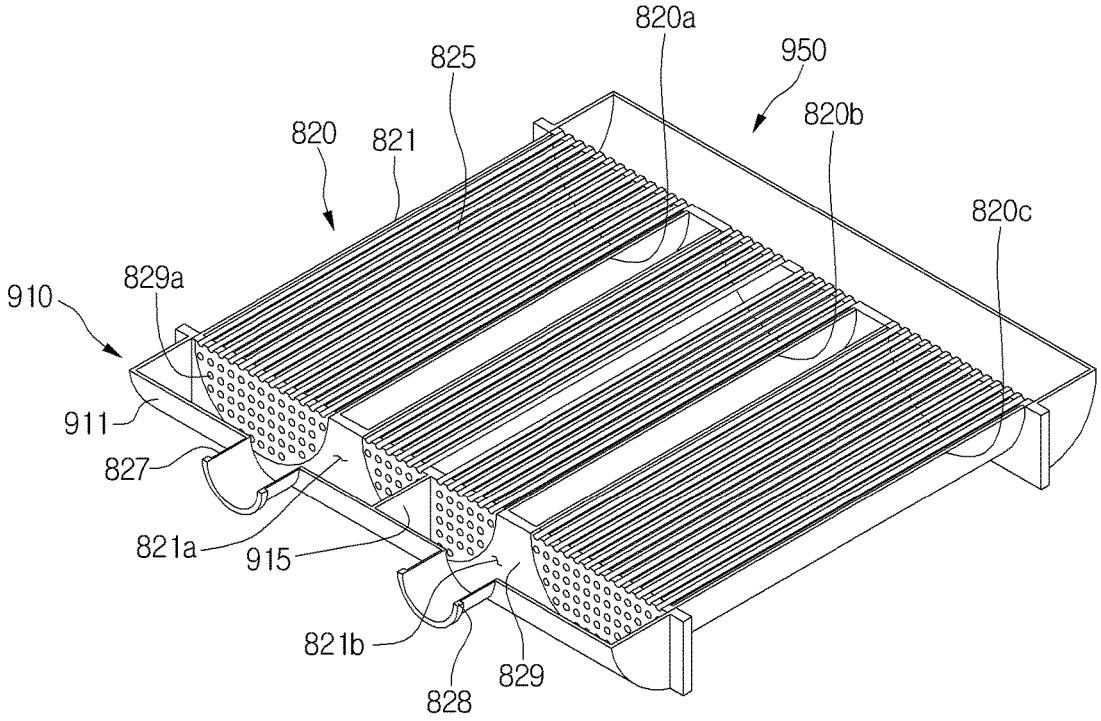
FIG. 28 is a cross-sectional view illustrating an inner structure of a portion of the module assembly according to the fourth exemplary embodiment.

FIG. 28 is a cross-sectional view illustrating an inner structure of a portion of the module assembly according to the fourth embodiment.

Referring to FIG. 28, a module assembly according to the fourth embodiment includes three chiller modules 800. Also, each of the chiller modules includes a condenser 820.

The condenser 820 according to the current embodiment includes three condensers arranged parallel to each other, i.e., a first condenser 820*a*, a second condenser 820*b*, and a third condenser 820*c*.

The condenser 820 includes a shell 821 defining an inner space, a plurality of coolant tubes 825 disposed within the shell 821 to guide a flow of the coolant, and shell coupling plates 829 disposed on both sides of the shell 821.

The plurality of coolant tubes 825 extend from one side of the shell 821 to the other side and then be coupled to the shell coupling plates 829, respectively A plurality of tube coupling parts 829*a* coupled to the coolant tubes 825 are disposed on the shell coupling plates 829. The tube coupling part 829*a* has a hole coupled to an end of the coolant tube 825.

Both ends of the coolant tube 825 may be coupled to the tube coupling part 829*a* and supported by the shell coupling plate 829. The coolant flowing into the coolant tube 825 may be heat-exchanged with a refrigerant outside the coolant tube 825.

Cap assemblies 910 and 950 are coupled to the outside of the shell coupling plates 829, respectively. The cap assemblies 910 and 950 include a first cap assembly 910 covering the one side shell coupling plate 829 and a second cap assembly 950 covering the other side shell coupling plate 829.

The first cap assembly 910 includes a first cap body 911 defining a flow space of the coolant and a passage partition part 915 disposed within the first cap body 911 to partition the flow space of the coolant.

The passage partition part 915 extends from an inner circumferential surface of the cap body 821 to the shell coupling plate 829. The flow space of the coolant is partitioned into an inflow space part 821*a* and a discharge space part 821*b* by the passage partition part 915.

The passage partition part 915 may be coupled to a position corresponding to an end of the second condenser 820*b* of the shell coupling plate 829. Thus, a portion of the tube coupling part 829*a* disposed on an end of the second condenser 820*b* defines an inlet passage of the coolant, and a remaining portion defines an outlet passage of the coolant.

In summary, the inflow space part 821*a* may be defined outside a portion of the first condenser 820*a* and the second condenser 820*b*, and the discharge space part 821*b* may be defined outside a remaining portion of the second condenser 820*b* and the third condenser 820*c*.

The first cap assembly 910 includes a coolant inflow part 827 through which the coolant is introduced and a coolant discharge part 828 through which the coolant is discharged.

The coolant inflow part 827 and the coolant discharge part 828 may protrude outward from the first cap body 911.

The inflow space part 821*a* may be defined inside the coolant inflow part 827 to guide the coolant so that the coolant is introduced into the coolant tube 825. Also, the discharge space part 821*b* may be defined inside the coolant discharge part 828 to guide the coolant so that the coolant passing through the coolant tube 825 flows into the coolant discharge part 828.

The second cap assembly 950 is disposed on a side opposite to that of the first cap assembly 910 with respect to the shell 821 to switch a flow direction of the coolant passing through the condenser 820.

For example, the coolant passing through the condenser 820 of one chiller module 800 may be introduced into the condenser 820 of the other chiller module 800 via the second cap assembly 950. Also, the coolant passing through one portion of the condenser 820 of the one chiller module may be introduced into the other portion of the condenser 820 of the one chiller module 800 via the second cap assembly 950.

Figure 29:
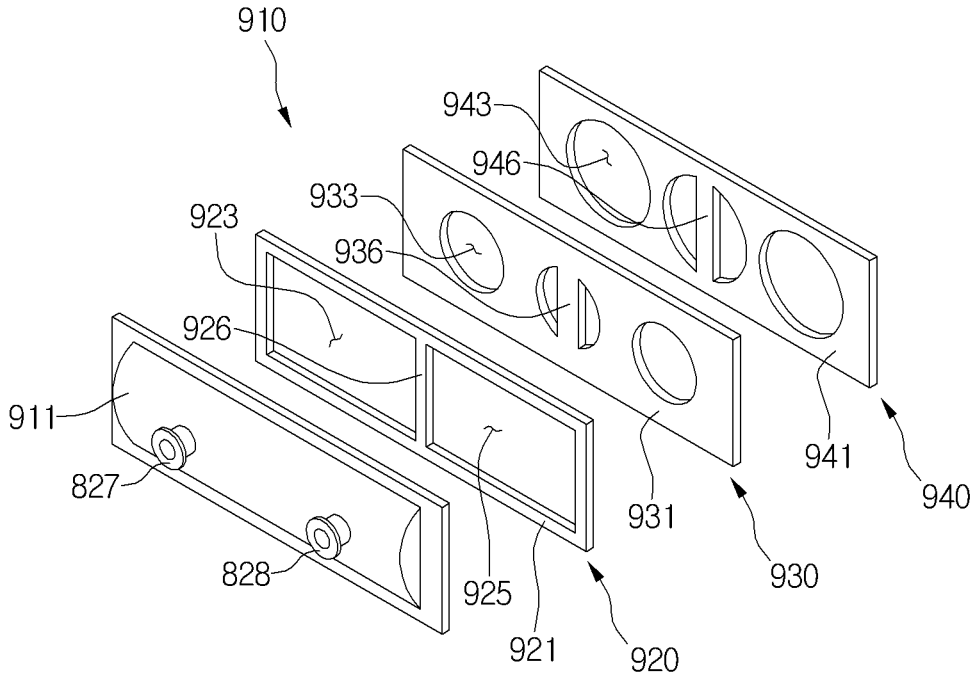
FIG. 29 is an exploded perspective view of a first cap assembly according to the fourth exemplary embodiment.
Figure 30:
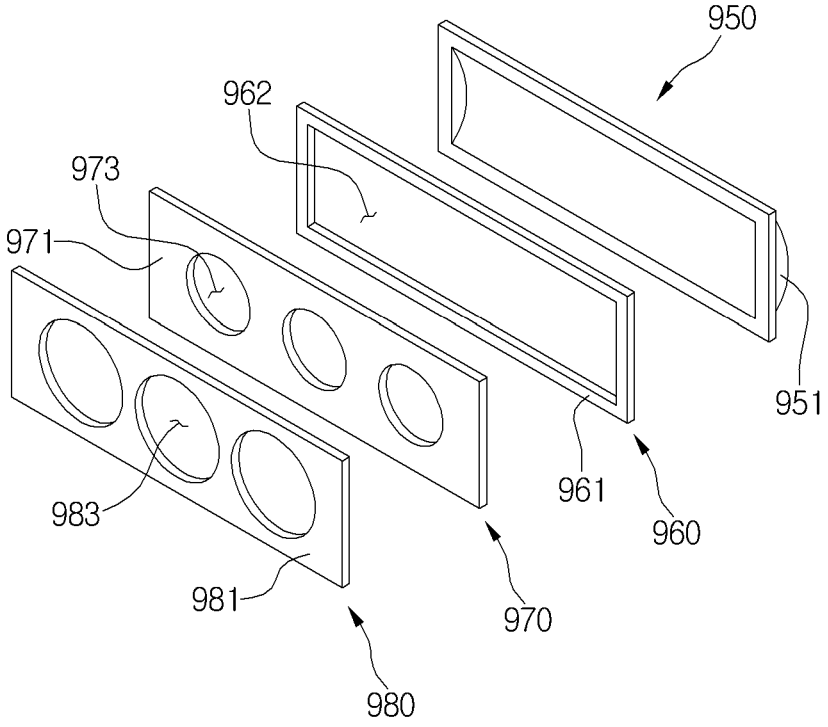
FIG. 30 is an exploded perspective view of a second cap assembly according to the fourth exemplary embodiment.

FIG. 29 is an exploded perspective view of the first cap assembly according to the fourth exemplary embodiment, and FIG. 30 is an exploded perspective view of the second cap assembly according to the fourth embodiment.

Referring to FIG. 29, the first cap assembly 910 according to the fourth embodiment includes a first cap body 911, a first tube sheet 930, and a plurality of gaskets 920 and 940.

A flow space of condensed water may be defined within the first cap body 911. For this, at least one portion of the first cap body 911 may be curved. Also, the coolant inflow part 827 and the coolant discharge part 828 are disposed in the first cap body 911.

The first tube sheet 930 may be understood as a sheet coupled to a side of the coolant tube 825 of the condenser 820.

An approximately square-shaped sheet body 931 and a plurality of first shell communication part 933 communicating with the shell 821 of each of the condensers 820 are disposed in the first tube sheet 930. The first shell communication part 933 is provided as a hole defined by cutting a portion of the sheet body 931.

Since the module assembly according to the current embodiment includes three condensers, three first shell communication parts may be provided. The three first shell communication parts 933 may be parallely spaced apart from each other in a transverse direction. Also, each of the first shell communication parts 933 may have an approximately circular shape corresponding to that of the shell 821.

A sheet partition part 936 is disposed on one first shell communication part 933 of the plurality of first shell communication parts 933. The sheet partition part 936 extends from one side of the first shell communication part 233 to the other side and is disposed on a position corresponding to that of the passage partition part 915.

The first shell communication part 933 disposed on the sheet partition part 936 of the three first shell communication parts 933 may be the first shell communication part 933 that is disposed at a middle portion.

With respect to the sheet partition part 936, the first shell communication part 933 disposed on one side of the sheet partition part 936 may be understood as an inflow passage through which the coolant is introduced into the condenser 920, and the first shell communication part 933 disposed on the other side of the sheet partition part 936 may be understood as a discharge passage through which the coolant is discharged into the condenser 280.

The plurality of gaskets 920 and 940 are disposed on both sides of the first tube sheet 930. The gaskets 920 and 940 prevent the coolant from leaking.

In detail, the plurality of gaskets 920 and 940 include a first gasket 920 disposed between the first cap body 911 and the first tube sheet 930.

The first gasket 920 includes a first gas body 921 and a first gasket partition part 926. The first gasket body 921 may have an approximately hollow square shape and be closely attached to an edge of the first cap body 911.

The first gasket partition part 926 is disposed on a position corresponding to that of the passage partition part 915. Also, the first gasket partition part 926 is disposed between the passage partition part 915 and the sheet partition part 936. An inner space of the first gasket body 921 may be defined into an inflow opening 923 and a discharge opening 925 by the first gasket partition part 926.

The inflow opening 923 may be an opening corresponding to the inflow space part 821*a* of the first cap body 911, and the discharge opening 925 may be an opening corresponding to the discharge space part 821*b* of the first cap body 911.

The plurality of gaskets 920 and 940 include a second gasket 940 disposed on a side opposite to that of the first gasket 920 with respect to the first tube sheet 930. The first gasket 920 may be disposed outside the first tube sheet 930, and the second gasket 940 may be disposed inside the first tube sheet 930.

The second gasket 940 may have a shape similar to that of the first tube 930. The second gasket 940 includes a second gasket body 941, a plurality of second shell communication parts 943, and a second gasket partition part 946. The second gasket partition part 946 may be coupled to the sheet partition part 936.

With respect to the second gasket partition part 946, the second shell communication part 943 disposed on one side of the second gasket partition part 946 may be understood as an inflow passage through which the coolant is introduced into the condenser 820, and the second shell communication part 943 disposed on the other side of the second gasket partition part 946 may be understood as a discharge passage through which the coolant is discharged into the condenser 820.

When the first cap body 911, the first tube sheet 930, and the gaskets 920 and 940 are coupled to each other, the first gasket partition part 926, the sheet partition part 936, and the second gasket partition part 946 are coupled to each other. Thus, the inflow space part 821*a* and the discharge space pat 821*b* may be sealed.

Referring to FIG. 30, the second cap assembly 950 according to the fourth embodiment includes a second cap body 951, a second tube sheet 970, and a plurality of gaskets 960 and 980.

At least one portion of the second cap body 951 may be curved so that a flow space is defined therein. The second tube sheet 970 may be understood as a sheet coupled to the other side of the coolant tube 825 of the condenser 820.

The second tube sheet 970 includes a sheet body 971 and a plurality of third shell communication parts 973. The third shell communication parts 973 are similar to the first shell communication part 933, and thus, are denoted by the first shell communication part 933.

The plurality of gaskets 960 and 980 include a third gasket 960 and a fourth gasket 980. The third gasket 960 has a third gasket body 961 and an opening 962 through which the coolant passes. Also, the fourth gasket 980 includes a fourth gasket body 981 and a plurality of shell communication part 983 communicating with the shell 821.

Referring to FIGS. 29 and 30, it is seen that the first cap assembly 910 is equal to the second cap assembly 950 except that the first cap assembly further includes the first gasket partition part 926, the sheet partition part 936, and the second gasket partition part 946.

Figure 31:
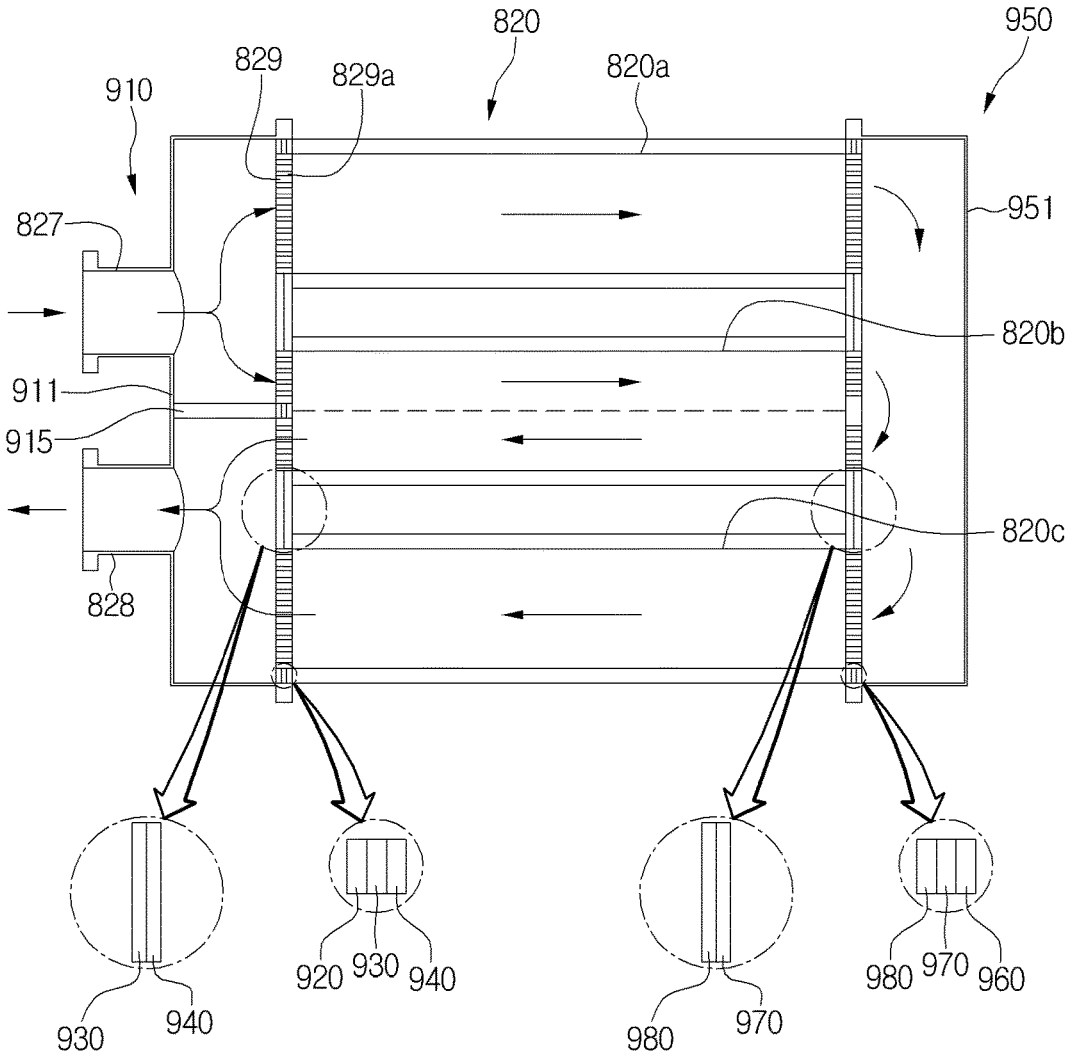
FIG. 31 is a cross-sectional view illustrating a flow of coolant into a condenser according to the fourth exemplary embodiment.
Figure 32:
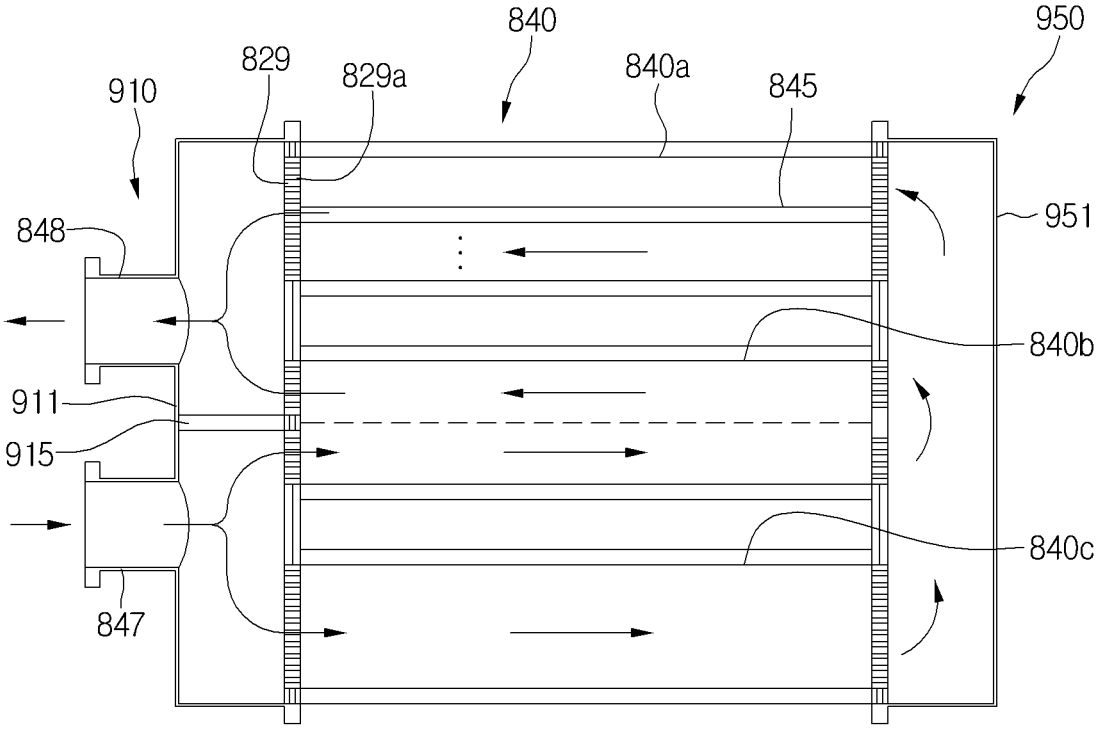
FIG. 32 is a cross-sectional view illustrating a flow of cold water into an evaporator according to the fourth exemplary embodiment.

FIG. 31 is a cross-sectional view illustrating a flow of coolant into a condenser according to the fourth embodiment, and FIG. 32 is a cross-sectional view illustrating a flow of cold water into an evaporator according to the fourth embodiment. For convenience of description, the coolant tube and the cold water tube are omitted in FIGS. 31 and 32. However, as shown in FIG. 28, it is obvious that the water tube is provided within the condenser and the evaporator.

Referring to FIG. 31, the module assembly according to the current embodiment includes three condensers 820*a*, 820*b*, and 820*c*, a first cap assembly 910 coupled to one side of the three condensers 820*a*, 820*b*, and 820*c*, and a second cap assembly 950 coupled to the other side of the three condensers 820*a*, 820*b*, and 820*c*.

The condensers 820*a*, 820*b*, and 820*c* include a first condenser 820*a*, a second condenser 820*b*, and a third condenser 820*c*, which are disposed in each of the chiller modules.

When the coolant is introduced through the coolant inflow part 827 of the first cap assembly 910, the coolant flows into the inflow space part 821*a* of the first cap body 911. Also, a flow of the coolant from the inflow space part 821*a* into the discharge space part 821*b* may be restricted by the passage partition part 915.

The refrigerant flowing into the inflow space part 821*a* is introduced into a portion of the coolant tube 825 of the first condenser 820*a* and the coolant tube 825 of the second condenser 820*a*.

Here, since spaces between the first cap assembly 910 and the condensers 820*a* and 820*b* are sealed by the first tube sheet 930 and the gaskets 920 and 940, it may prevent the coolant from leaking to the outside of the first cap assembly 910 or the condensers 820*a* and 820*b*.

The coolant heat-exchanged with the refrigerant while flowing into the first and second condensers 820*a* and 820*b* may flow into the second cap assembly 950 and then be switched in flow direction. The refrigerant flowing into the second cap body 951 of the second cap assembly 950 may flow into the remaining tube of the second condenser 820*b* and the coolant tube 825 of the third condenser 820*c*.

Here, since spaces between the second cap assembly 950 and the condensers 820*a*, 820*b*, and 820*c* are sealed by the second tube sheet 970 and the gaskets 960 and 980, it may prevent the coolant from leaking to the outside of the second cap assembly 950 or the condensers 820*a*, 820*b*, and 820*c*.

Thus, the coolant tube 825 of the second condenser 820*b* includes a coolant tube (hereinafter, referred to as a first coolant tube) guiding a flow of the refrigerant from the first cap assembly 910 toward the second cap assembly 950 and a coolant tube (hereinafter, referred to as a second coolant tube) guiding a flow of the refrigerant from the second cap assembly 950 toward the first cap assembly 910.

The first coolant tube is disposed on one side of the inflow space part 821*a*, and the second coolant tube is disposed on one side of the discharge space part 821*b*.

The refrigerant flowing into the second and third condensers 820*b* and 820*c* may pass through the shell coupling part 829 to flow into the discharge space part 821*b*. Here, a flow of the coolant from the discharge space part 821*b* into the inflow space part 821*a* may be restricted by the passage partition part 915.

The coolant within the discharge space part 821*b* may be discharged through the coolant discharge part 828. Here, since spaces between the first cap assembly 910 and the condensers 820*b* and 820*c* are sealed by the first tube sheet 930 and the gaskets 920 and 940, it may prevent the coolant from leaking to the outside of the first cap assembly 910 or the condensers 820*b* and 820*c*.

Referring to FIG. 32, the module assembly according to the current embodiment includes three evaporators 840*a*, 840*b*, and 840*c*, a first cap assembly 910 coupled to one side of the three evaporators 840*a*, 840*b*, and 840*c*, and a second cap assembly 950 coupled to the other side of the three evaporators 840*a*, 840*b*, and 840*c*.

Here, since the first and second cap assemblies 910 and 950 have the same constitution as the first and second cap assemblies 910 and 950 disposed on the one side and the other side of the condenser 820, their additional descriptions will be omitted.

Also, shell coupling plates 829 having a tube coupling part 829*a* coupled to the cold water tube may be disposed on one side and the other side of the evaporators 840*a*, 840*b*, and 840*c*. Since these constitutions are the same as those of the condenser, their detailed descriptions will be omitted.

The evaporators 840*a*, 840*b*, and 840*c* include a first evaporator 840*a*, a second evaporator 840*b*, and a third evaporator 840*c*, which are disposed in each of the chiller modules. The first, second, and third evaporators 840*a*, 840*b*, and 840*c* may be disposed under the first, second, and third condensers 820*a*, 820*b*, and 820*c*, respectively.

The first cap assembly 910 includes a cold water inflow part 847 through which the cold water is introduced and a cold water discharge part 848 through which the cold water is discharged. The cold water discharge part 848 is disposed under the coolant inflow part 827, and the cold water inflow part 847 is disposed under the coolant discharge part 828.

That is, with respect to the condenser 820 and the evaporator 840 which are vertically disposed, inflow and discharge directions of the coolant and cold water may be opposite to each other (counter flow).

In detail, the cold water introduced through the cold water inflow part 847 is introduced into a cold water tube 845 disposed in the third evaporator 840*a* via the inflow space part 821*a* and a portion of a cold water tube 845 disposed in the second evaporator 840*b*.

Also, a flow of the cold water from the inflow space part 821*a* into the discharge space part 821*b* may be restricted by the passage partition part 915.

Here, since spaces between the first cap assembly 910 and the evaporators 840*b* and 840*c* are sealed by the first tube sheet 930 and the gaskets 920 and 940, it may prevent the cold water from leaking to the outside of the first cap assembly 910 or the evaporators 840*b* and 840*c*.

A flow direction of the refrigerant passing through the second evaporator 840*b* and the third evaporator 840*c* may be switched in the second cap assembly 950 to pass through a portion of the tube of the second evaporator 840*b* and the cold water tube 845 of the first evaporator 840*a*.

Here, since spaces between the second cap assembly 950 and the evaporators 840*a*, 840*b*, and 840*c* are sealed by the second tube sheet 970 and the gaskets 960 and 980, it may prevent the cold water from leaking to the outside of the second cap assembly 950 or the evaporators 840*a*, 840*b*, and 840*c*.

Thus, the cold water tube 845 of the second evaporator 840*b* includes a cold water tube (hereinafter, referred to as a first cold water tube) guiding a flow of the refrigerant from the first cap assembly 910 toward the second cap assembly 950 and a cold water tube (hereinafter, referred to as a second cold water tube) guiding a flow of the refrigerant from the second cap assembly 950 toward the first cap assembly 910.

The first cold water tube is disposed on one side of the inflow space part 821*a*, and the second cold water tube is disposed on one side of the discharge space part 821*b*. The refrigerant passing through the first and second evaporators 840*a* and 840*b* may flow into the discharge space part 821*b* and then be discharged through the cold water discharge part 848.

The first coolant tube and the first cold water tube may be called a "first water tube", and the second coolant tube and the second cold water tube may be called a "second water tube".

Figure 33:
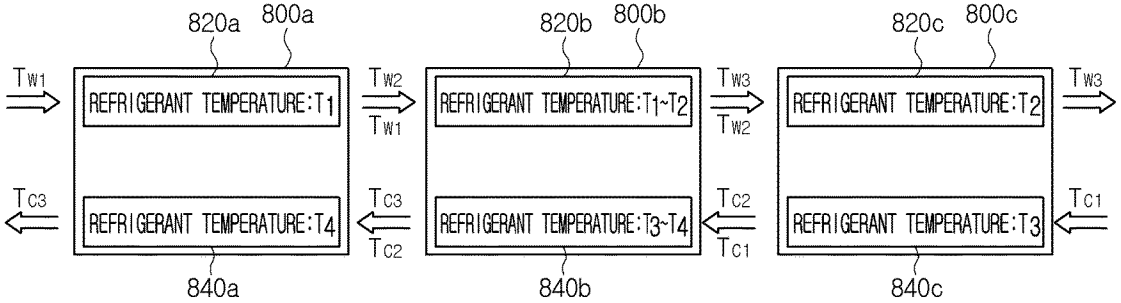
FIG. 33 is a view illustrating temperature changes of a heat-exchanged refrigerant, cold water, and coolant in the module assembly according to the fourth exemplary embodiment.

FIG. 33 is a view illustrating temperature changes of a heat-exchanged refrigerant, cold water, and coolant in the module assembly according to the fourth embodiment.

FIG. 33 illustrates flows of the coolant and cold water in the plurality of chiller modules 800, i.e, first, second, and third chiller modules 800*a*, 800*b*, and 800*c* according to the current embodiment. The first chiller module 800*a*, the second chiller module 800*b*, and the third chiller module 800*c* perform independent refrigeration cycles, respectively.

The coolant is introduced into the cold water tube 825 of the first condenser 820*a* or a portion of the cold water tube 825 of the second condenser 820*b* at a temperature $T_{w1}$ and then primarily heat-exchanged. Also, the coolant is introduced into the remaining coolant tube 825 of the second condenser 820*b* or the third condenser 820*c* and then secondarily heat-exchanged.

Here, the coolant has a temperature $T_w2$ after being primarily heat-exchanged and a temperature $T_{w3}$ after being secondarily heat-exchanged.

For example, the temperature $T_{w1}$ may be about 32° C., the temperature $T_{w2}$ may be 34.5° C., and the temperature $T_{w3}$ may be about 37° C. That is, the coolant may be introduced at a temperature of about 32° C. and discharged at a temperature of about 37° C. to cause a temperature difference $\Delta T_w$ of about 5° C.

Also, in the process, the refrigerant passing through the first condenser 820*a* may have a temperature $T_1$, and the refrigerant passing through the second condenser 820*b* may have a temperature ranging from $T_1$ to $T_2$. Also, the refrigerant passing through the third condenser 820*c* may have a temperature $T_3$. For example, the temperature $T_1$ may be about 35.5° C., and the temperature $T_2$ may be 38° C.

The cold water is introduced into the cold water tube 840 of the third evaporator 840*c* or a portion of the cold water tube 845 of the second evaporator 840*b* at a temperature $T_{c1}$ and then primarily heat-exchanged. Also, the cold water is introduced into the remaining cold water tube 845 of the second evaporator 840*b* or the first evaporator 840*a* and then secondarily heat-exchanged.

Here, the cold water has a temperature $T_{c2}$ after being primarily heat-exchanged and a temperature $T_{c3}$ after being secondarily heat-exchanged. For example, the temperature $T_{c1}$ may be about 12° C., the temperature $T_{c2}$ may be about 9.5° C., and the temperature $T_{c3}$ may be about 7° C. That is, the cold water may be introduced at a temperature of about 12° C. and discharged at a temperature of about 7° C. to cause a temperature difference $\Delta T_c$ of about 5° C.

Also, in the process, the refrigerant passing through the third evaporator 840*c* may have a temperature $T_3$, and the refrigerant passing through the second evaporator 840*b* may have a temperature ranging from $T_3$ to $T_4$. Also, the refrigerant passing through the first evaporator 840*a* may have a temperature $T_4$. For example, the temperature $T_3$ may be about 8° C., and the temperature $T_4$ may be about 5.5° C.

As a result, in the chiller module, a difference $\Delta T_1$ between the condensing temperature 38° C. ($T_2$) and the evaporating temperature 8° C. ($T_3$) in the first chiller module 800*a* may be about 30° C., and a difference $\Delta T_2$ between the condensing temperature 35.5° C. ($T_1$) and the evaporating temperature 5.5° C. ($T_4$) in the third chiller module 800*c* may be about 30° C. Also, a difference $\Delta T_3$ between the condensing temperature and the evaporating temperature in the second chiller module 800*b*, i.e., $T_2$-$T_3$ or $T_1$-$T_4$ may be about 30° C.

Thus, in the refrigeration cycle of each of the chiller modules 800*a*, 800*b*, and 800*c*, a difference between a high pressure and a low pressure may be generated as a pressure corresponding to the temperature difference (30° C.)

On the other hand, in a case of the single chiller unit (the related art) having the same refrigeration ability as that of the module assembly according to the current embodiment, to obtain a desired cold water discharge temperature, the coolant and cold water temperatures of the condenser and evaporator through which the coolant and cold water are respectively discharged define the condensing and evaporating temperatures, respectively.

That is, since the condensing temperature is about 38° C., and the evaporating temperature is about 5.5° C., a difference value between the condensing temperature and the evaporating temperature may be about 32.5° C. Thus, in the refrigeration cycle of the single chiller, a difference between a high pressure and a low pressure may be defined as a pressure corresponding to the temperature difference (32.5° C.)

In summary, when compared to the single chiller unit according to the related art, in the case of the module assembly according to the current embodiment, since the difference between the high pressure and the low pressure in the refrigeration cycle is less, system efficiency in the current embodiment may be improved.

According to the embodiments, since the chiller units are provided as modulation, the chiller units may be quickly and effectively manufactured according to a scale of the building in which the chiller system is installed or required air-conditioning ability.

Also, even though the chiller module is broken down in use of the chiller system, only the broken chiller module may be repaired or replaced. Thus, a phenomenon in which the chiller system does not operate for a long time may be prevented.

Also, since the plurality of module control device for operating the plurality of chiller modules and the main control device for controlling the plurality of module control devices are separately provided, the chiller system may stably and reliably operate.

Also, since the plurality of chiller modules successively operate by using one starting device according to the required refrigeration ability, power consumption due to sudden increase of the starting current may be reduced.

Also, since only chiller module having predetermined ability is produced, and then the plurality of chiller modules are assembled according to the required refrigeration ability to manufacture a completed chiller unit, quick response according to demands of market may be enabled.

Also, in a state where the condenser and the evaporator are provided in one chiller module, the plurality of chiller modules may be adequately arranged according to a required flow rate of the cold water.

Also, the flow direction of the coolant circulating into the cooling tower and the condenser of the chiller module and the flow direction of the cold water circulating to the customers and the evaporator of the chiller module may be opposite to each other (counter flow). Thus, a difference between the condensing temperature and the evaporating temperature of the refrigerant may be reduced. As a result, since a difference value between the high pressure and the low pressure is less, the refrigeration system may be improved in efficiency.

Particularly, in the case where odd numbers of chiller modules, for example, three chiller modules are coupled to each other to constitute the system, the coolant or cold water introduced through the inflow part may be branched to circulate into the condenser or the evaporator. Then, the circulating coolant or cold water may be mixed with each other and then be discharged through the discharge part. Thus, the counter flow effect may be obtained.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A chiller system comprising:

a plurality of chiller modules in which a refrigeration cycle using an odd number of chiller modules is performed to supply cold water, the plurality of chiller modules each comprising a condenser in which coolant is circulated and an evaporator in which cold water is circulated;

a module control device to generate an operation signal to simultaneously or successively operate the plurality of chiller modules, the module control device controlling operations of the chiller modules;

a water tube disposed within the condenser or the evaporator to guide a flow of the coolant or the cold water;

a first cap assembly disposed on one side of the plurality of chiller modules, the first cap assembly comprising an inlet for the cold water or the coolant and an outlet for the cold water and the coolant; and a passage partition part disposed on the first cap assembly to restrict introduction of the cold water through the inlet into the water tube of the condenser or the evaporator.

2. The chiller system according to claim 1, wherein the first cap assembly comprises a first cap body to define a flow space of the coolant or the cold water, and wherein the flow space is partitioned into an inflow space part in which the coolant or the cold water is introduced into the plurality of chiller modules and a discharge space part in which the coolant or the cold water is discharged from the chiller modules by the passage partition part.

3. The chiller system according to claim 2, wherein each of the plurality of chiller modules comprises a shell coupling plate disposed on at least one side of the condenser or the evaporator and comprising a tube coupling part coupled to the water tube, and wherein the passage partition part extends from an inner circumferential surface of the first cap body to the shell coupling plate.

4. The chiller system according to claim 2, further comprising a second cap assembly disposed on the another side of the plurality of chiller modules to switch a flow direction of the cold water passing through the water tube.

5. The chiller system according to claim 4, wherein the condenser or evaporator comprises:

a first water tube to guide a flow of the cold water from the first cap assembly to the second cap assembly; and a second water tube to guide a flow of the cold water from the second cap assembly to the first cap assembly.

6. The chiller system according to claim 1, wherein the first cap assembly comprises:

a tube sheet coupled to the water tube; and a gasket disposed on at least one side of the tube sheet to prevent water from leaking through the first cap assembly.

7. The chiller system according to claim 6, wherein the tube sheet or the gasket comprises:

a communication part communicating with the water tube of the condenser or evaporator; and a partition part extending from one side of the communication part to the other side, the partition part being coupled to the passage partition part.

8. The chiller system according to claim 1, wherein the condenser and the evaporator are vertically disposed, and the first cap assembly is disposed on a side of each of the condenser and the evaporator, and wherein the inlet of the first cap assembly disposed on the side of the condenser is disposed above or below the outlet of the first cap assembly disposed on the side of the evaporator.

* * * * *